US010045617B2

(12) United States Patent
Lehndorf et al.

(10) Patent No.: US 10,045,617 B2
(45) Date of Patent: Aug. 14, 2018

(54) PHARMACEUTICAL MANAGEMENT STORAGE CABINET

(71) Applicant: Midwest Products and Engineering, Inc., Milwaukee, WI (US)

(72) Inventors: Natasha L. Lehndorf, Cudahy, WI (US); Tony Le, New Berlin, WI (US); Jeff George, Chicago, IL (US); Lou Lucchi, Chandler, AZ (US); Nadder D. Sahar, Milwaukee, WI (US); Christian J. Stefanovitz, West Bend, WI (US); David P. Bongard, Mequon, WI (US); Daniel S. Margulis, Milwaukee, WI (US)

(73) Assignee: Midwest Products and Engineering, Inc., Milwaukee, WI (US)

( * ) Notice: Subject to any disclaimer, the term of this patent is extended or adjusted under 35 U.S.C. 154(b) by 167 days.

(21) Appl. No.: 15/165,829

(22) Filed: May 26, 2016

(65) Prior Publication Data

US 2016/0345728 A1 Dec. 1, 2016

Related U.S. Application Data

(60) Provisional application No. 62/166,214, filed on May 26, 2015.

(51) Int. Cl.
*A47B 67/02* (2006.01)
*E05B 65/462* (2017.01)

(52) U.S. Cl.
CPC ..... *A47B 67/02* (2013.01); *E05B 65/462* (2013.01); *A47B 2067/025* (2013.01)

(58) Field of Classification Search
CPC ..... A47B 67/02; A47B 67/025; A47B 67/04; A47B 2067/025; A47B 87/0284; A47B 63/062; A47B 88/48; A47B 88/60; A47B 49/004; E05B 65/462; E05B 65/464; E05B 65/465; E05B 65/467; E05B 65/468; E05B 65/46; E05B 65/463; B25H 3/025; F25D 25/005; F25D 25/027; B65D 21/0233; H05K 7/18
(Continued)

(56) References Cited

U.S. PATENT DOCUMENTS 560,266 A * 5/1896 Herrick ..... A47B 67/005 312/227
2,955,892 A * 10/1960 Pulaski ..... A47B 49/004 211/150

(Continued)

*Primary Examiner* — Hiwot E Tefera
(74) *Attorney, Agent, or Firm* — Michael Best & Friedrich LLP

(57) ABSTRACT

A storage cabinet includes a base fixedly attached to a wall and a frame coupled to the base. The frame includes a first side, a second side, and a cavity. The storage cabinet also includes a storage bin having a first side and a second side. The storage bin is removably positionable within the cavity such that the first side of the storage bin is retained within the cavity by a flange of the frame extending from the first side of the frame toward the second side of the frame, and the second side of the storage bin is adjacent the second side of the frame. The storage cabinet further includes a lock coupled to the base adjacent the second side of the frame. The lock selectively engages the second side of the storage bin to secure the storage bin in the cavity.

20 Claims, 22 Drawing Sheets

(58) Field of Classification Search
USPC .... 312/209, 245, 242, 123, 330.1, 326, 333, 312/300, 348.3, 216, 125, 249.7, 215, 312/217, 42, 292, 298, 329, 294, 291, 35, 312/234; 206/477–483, 372, 373; 292/32, 33, 42, 37, 345, 137, 138, 140; 211/81, 82
See application file for complete search history.

(56) References Cited

U.S. PATENT DOCUMENTS 3,150,902 A * 9/1964 Naab ..... E05B 65/462 312/217
3,172,713 A * 3/1965 Rupert ..... G07F 9/10 219/214
3,369,697 A 2/1968 Glucksman et al.
3,689,128 A * 9/1972 Andreini ..... A47B 49/004 312/274
3,715,148 A 2/1973 Beals
3,744,867 A 7/1973 Shaw
3,762,601 A 10/1973 McLaughlin
4,114,965 A 9/1978 Oye et al.
4,221,442 A * 9/1980 Harangozo ..... A24F 19/0092 312/242
4,616,890 A * 10/1986 Romick ..... E05B 65/462 312/216
5,069,511 A 12/1991 Swets et al.
5,126,732 A 6/1992 Mardon
5,139,321 A 8/1992 Beardsley
5,225,825 A 7/1993 Warren
5,346,297 A 9/1994 Colson, Jr. et al.
5,445,294 A 8/1995 Gardner et al.
5,516,203 A * 5/1996 Branham ..... A47B 88/60 16/82
5,520,450 A 5/1996 Colson, Jr. et al.
5,576,911 A * 11/1996 Porter ..... G11B 17/22 360/92.1
5,659,440 A * 8/1997 Acosta ..... G11B 15/6825 294/168
5,673,983 A * 10/1997 Carlson ..... A47B 67/04 312/218
5,745,366 A 4/1998 Higham et al.
5,795,042 A * 8/1998 Todor ..... E05B 65/462 312/221
5,871,623 A * 2/1999 Bakhir ..... C02F 1/4618 204/260
5,887,715 A * 3/1999 Vasudeva ..... B25H 3/023 206/373
6,049,451 A * 4/2000 Schmitt ..... E05B 63/143 312/216
6,155,659 A * 12/2000 Manes ..... G11B 15/6825 312/216
6,348,864 B1 * 2/2002 Lin ..... G07C 9/00166 340/539.1
6,409,290 B1 * 6/2002 Lin ..... E05B 65/462 312/217
7,469,980 B2 * 12/2008 Koo ..... F25D 23/04 312/321.5
7,668,620 B2 2/2010 Shoenfeld
7,712,850 B2 * 5/2010 Vasudeva ..... A47B 46/005 312/198
7,806,491 B2 * 10/2010 Lee ..... F25D 25/005 312/222
2005/0067925 A1 * 3/2005 Stone, III ..... A47B 46/00 312/249.2
2005/0115862 A1 * 6/2005 Maietta ..... B65D 83/0463 206/528
2007/0235397 A1 * 10/2007 Wannop ..... A47B 77/16 211/81
2007/0244598 A1 * 10/2007 Shoenfeld ..... G06F 19/3462 700/236
2010/0043177 A1 * 2/2010 Wildman ..... E05D 5/065 16/389
2010/0106291 A1 * 4/2010 Campbell ..... E05B 47/0002 700/231
2010/0123375 A1 * 5/2010 Romaen ..... E05B 65/462 312/215
2011/0062841 A1 * 3/2011 Penner ..... B25H 3/025 312/249.8
2012/0194051 A1 * 8/2012 Penner ..... B25H 3/025 312/249.11
2014/0070677 A1 * 3/2014 Baruch ..... E05B 65/467 312/216
2015/0253818 A1 * 9/2015 Wong ..... G06F 1/182 361/679.44
2016/0270534 A1 * 9/2016 Duval ..... A47B 96/00

* cited by examiner

PHARMACEUTICAL MANAGEMENT STORAGE CABINET

CROSS-REFERENCE TO RELATED APPLICATIONS

This application claims priority to U.S. Provisional Patent Application No. 62/166,214, filed on May 26, 2015, the contents of which are incorporated herein by reference.

FIELD OF THE INVENTION

The present disclosure relates to a pharmaceutical management storage cabinet, in particular to a lockable pharmaceutical management storage cabinet.

BACKGROUND

Hospitals and other healthcare facilities are seeking ways to increase medical staff's direct contact with patients by reducing unnecessary and inefficient tasks that occupy staff's time. Currently, nurses and other medical staff spend significant time retrieving medication and supplies from a centralized medication room, walking as much as five miles per day. Regulations require that medical staff only retrieve one patient's medication at a time, therefore requiring separate trips for each administration of medication. This retrieval of medication is inefficient and reduces available time for medical staff to care for patients and conduct other activities that provide greater value to the facility.

Studies suggest that nurses may spend less than 2 hours of a 12-hour shift in direct patient care. Increased interaction is shown to reduce patient injuries, infections and medication errors while increasing patient satisfaction. Additionally, medical reimbursement is increasingly tied to patient satisfaction and medical outcomes (i.e., avoidance of infections or errors). Therefore, it is important for healthcare facilities to find ways to increase engagement with patients to improve operational efficiencies and reduce errors.

Decentralization of medications (i.e., locating medications near nurses and patients instead of in a centralized medication room) represents a significant opportunity to improve efficiency for nurses and other medical staff. Some solutions for decentralizing medications exist but create other challenges for hospitals. For instance, medication carts can support medications near patient rooms, but the carts require maintenance (e.g., electrically charging the cart). Additionally, medication carts create clutter in the hallway, which is usually against hospitals' rules and regulations and can result in fines or create hazardous situations for patients and staff. Also, because the carts are moveable, their location may not always be known to medical staff.

SUMMARY

In one aspect, a storage cabinet is mountable to a wall. The storage cabinet includes a base configured to be fixedly attached to the wall and a frame coupled to the base. The frame includes a first side, a second side, and a cavity defined between the first and second sides. The storage cabinet also includes a storage bin having a first side and a second side. The storage bin is removably positionable within the cavity such that the first side of the storage bin is retained within the cavity by a flange of the frame extending from the first side of the frame toward the second side of the frame, and the second side of the storage bin is adjacent the second side of the frame. The storage cabinet further includes a lock coupled to the base adjacent the second side of the frame. The lock is configured to selectively engage the second side of the storage bin to secure the storage bin in the cavity.

In another aspect, a storage cabinet is mountable to a wall. The storage cabinet includes a base configured to be fixedly attached to the wall and a cassette removably supported by the base. The cassette includes a first side, a second side, a plurality of cavities defined between the first and second sides, and a flange extending from the first side of the cassette toward the second side of the cassette. The storage cabinet also includes a plurality of storage bins each including a first side, a second side, and a notch adjacent the first side. Each of the plurality of storage bins is removably positionable within one of the plurality of cavities such that the first side of each of the plurality of storage bins is retained within one of the plurality of cavities by the flange engaging the notch of each of the plurality of storage bins, and the second side of each of the plurality of storage bins is adjacent the second side of the cassette. The storage cabinet further includes a plurality of locks coupled to the base adjacent the second side of the cassette. Each of the plurality of locks configured to selectively engage the second side of one of the storage bins to secure the respective storage bin in a respective cavity.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

Figure 1:
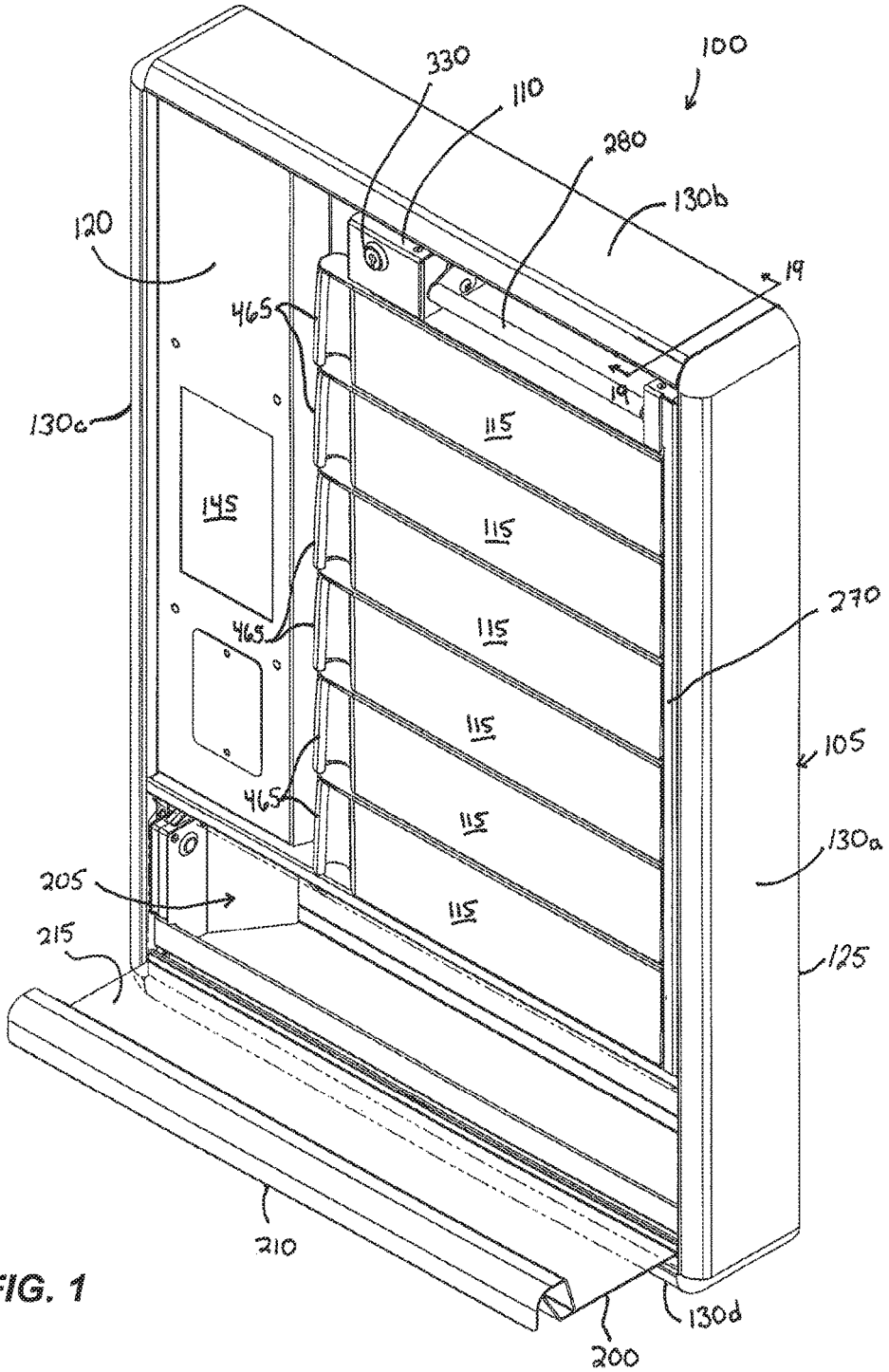
FIG. 1 is a perspective view of a pharmaceutical storage cabinet including a plurality of storage bins, a cassette coupled to the plurality of storage bins, and a base coupled to the cassette according to an embodiment of the disclosure.
Figure 2:
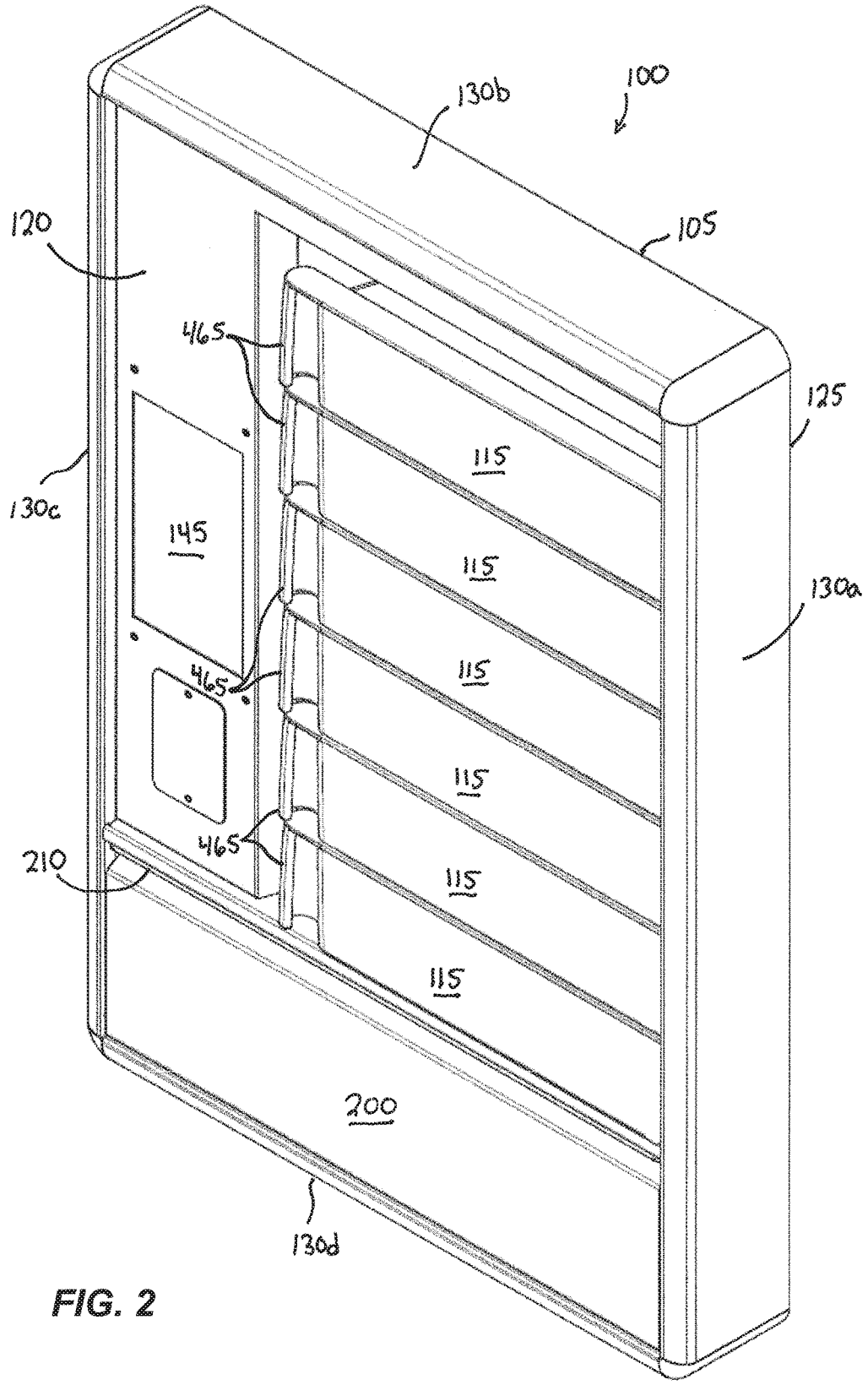
FIG. 2 is a perspective view of a pharmaceutical storage cabinet including a plurality of storage bins coupled to a base according to another embodiment of the disclosure.
Figure 4:
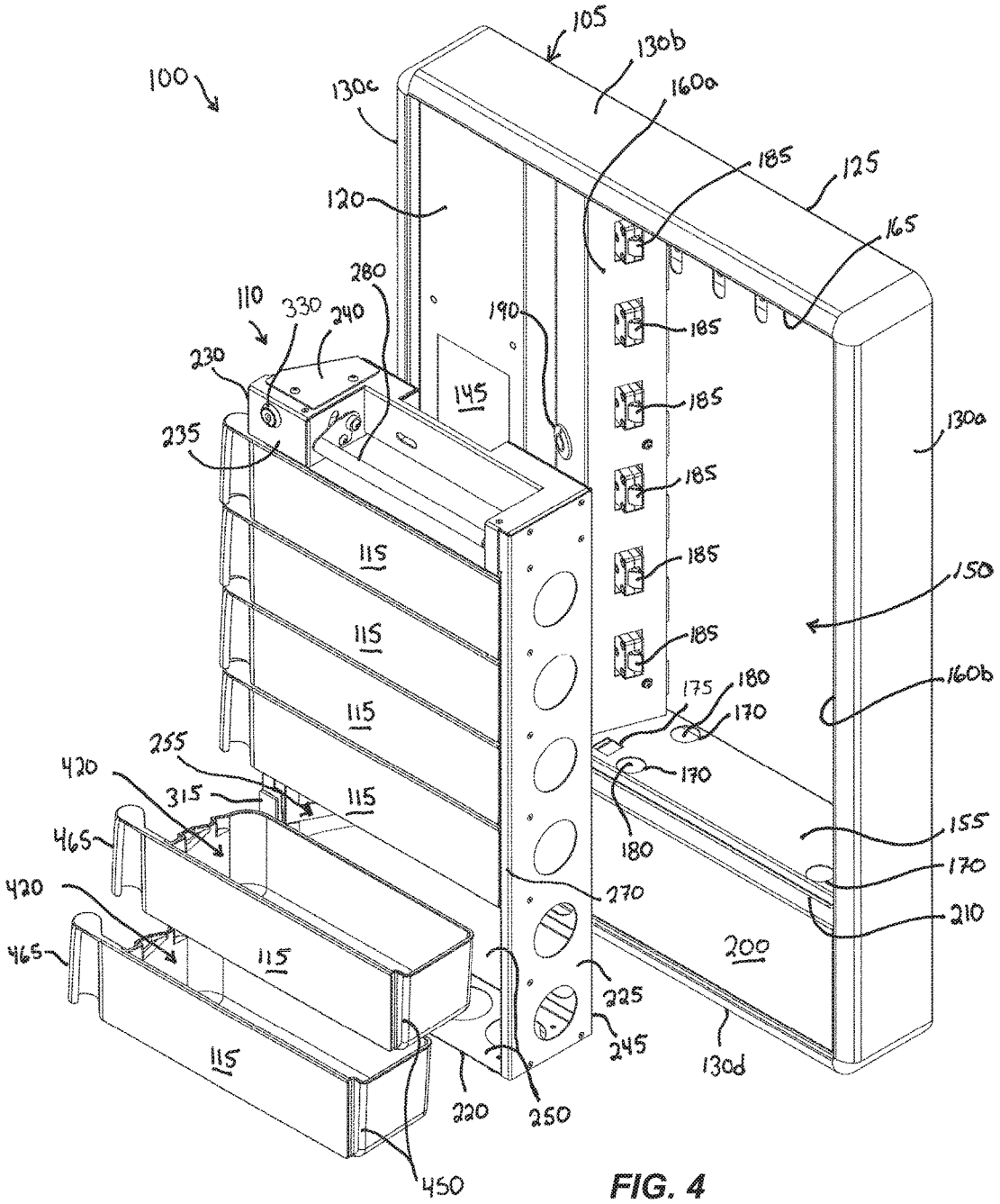
FIG. 4 is an exploded view of the pharmaceutical storage cabinet of FIG. 1.

FIG. 1 illustrates a pharmaceutical management unit (e.g., a storage cabinet 100) including a base 105, a frame or cassette 110, and a plurality of storage bins 115. In one embodiment, the storage bins 115 are removably coupled to the cassette 110, and the cassette 110 is removably coupled to the base 105 (FIG. 4). In other embodiments as illustrated in FIG. 2, the storage bins 115 are removably coupled to the frame 110, which is integrally formed with the base 105 (e.g., the storage bins 115 are coupled to the base 105). The illustrated storage cabinet 100 is configured to be located in a hospital to securely store pharmaceuticals for a plurality of patients within the hospital. For example, the storage cabinet 100 may be positioned near hospital patients' rooms. In other embodiments, the storage cabinet 100 may be located in pharmacies or other healthcare facilities where secure storage of pharmaceuticals is required. In further embodiments, the storage cabinet 100 may also securely store medical equipment or materials.

Figure 3:
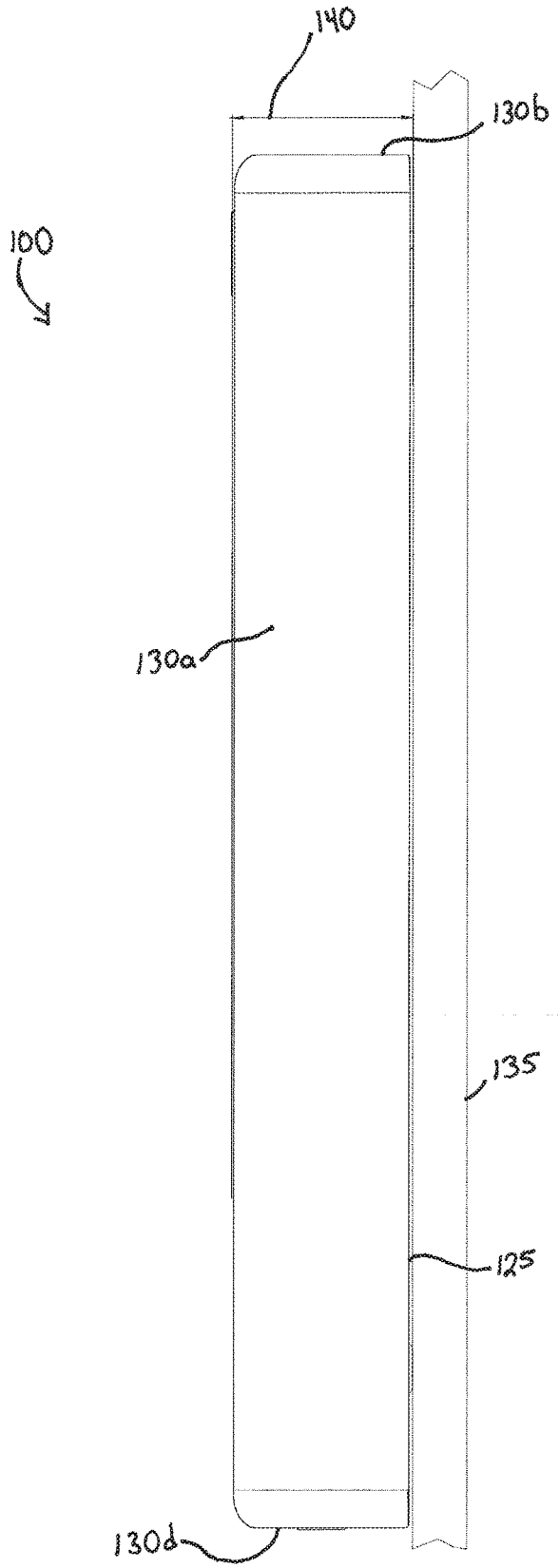
FIG. 3 is a side view of the pharmaceutical storage cabinet of FIG. 1 mountable to a wall.

With reference to FIGS. 1 and 3, the illustrated base 105 includes a front side 120, a rear side 125, and side surfaces 130*a*, 130*b*, 130*c*, 130*d* extending between the front side 120 and the rear side 125. The rear side 125 is fixedly mounted to a wall 135 by, for example, fasteners. In one embodiment, the wall 135 is a hallway wall of a hospital, or in other embodiments, the wall 135 may be a wall within a room of a hospital. When mounted to the wall 135, the side surfaces 130*a*, 130*b*, 130*c*, 130*d* extend from the wall 135 at a distance 140. In other words, no part of the storage cabinet 100 extends beyond the distance 140. In the illustrated embodiment, the distance 140 is about 4 inches (e.g., 4.01 inches) to comply with some hospital regulatory standards that inhibit any object located within a hallway of a hospital to be more than a specified distance from the wall 135. In other embodiments, the distance 140 may be less than or greater than about 4 inches (e.g., about 6 inches). In further embodiments, the management unit 100 may not be fixed to the wall 135 and moveable by wheels (e.g., the management unit 100 may be a moveable cart).

In addition, a user interface display 145 is located on the front side 120. In the illustrated embodiment, the user interface 145 is a touch-screen that is configured to control and operate the storage cabinet 100 by a medical professional (e.g., a nurse or other medical staff). In the illustrated embodiment, the user interface 145 is powered by a power source (e.g., an AC power source) located within the wall 135. In other embodiments, the interface display 145 may be powered a battery (e.g., a rechargeable lithium-ion battery) coupled to the base 105.

Figure 5:
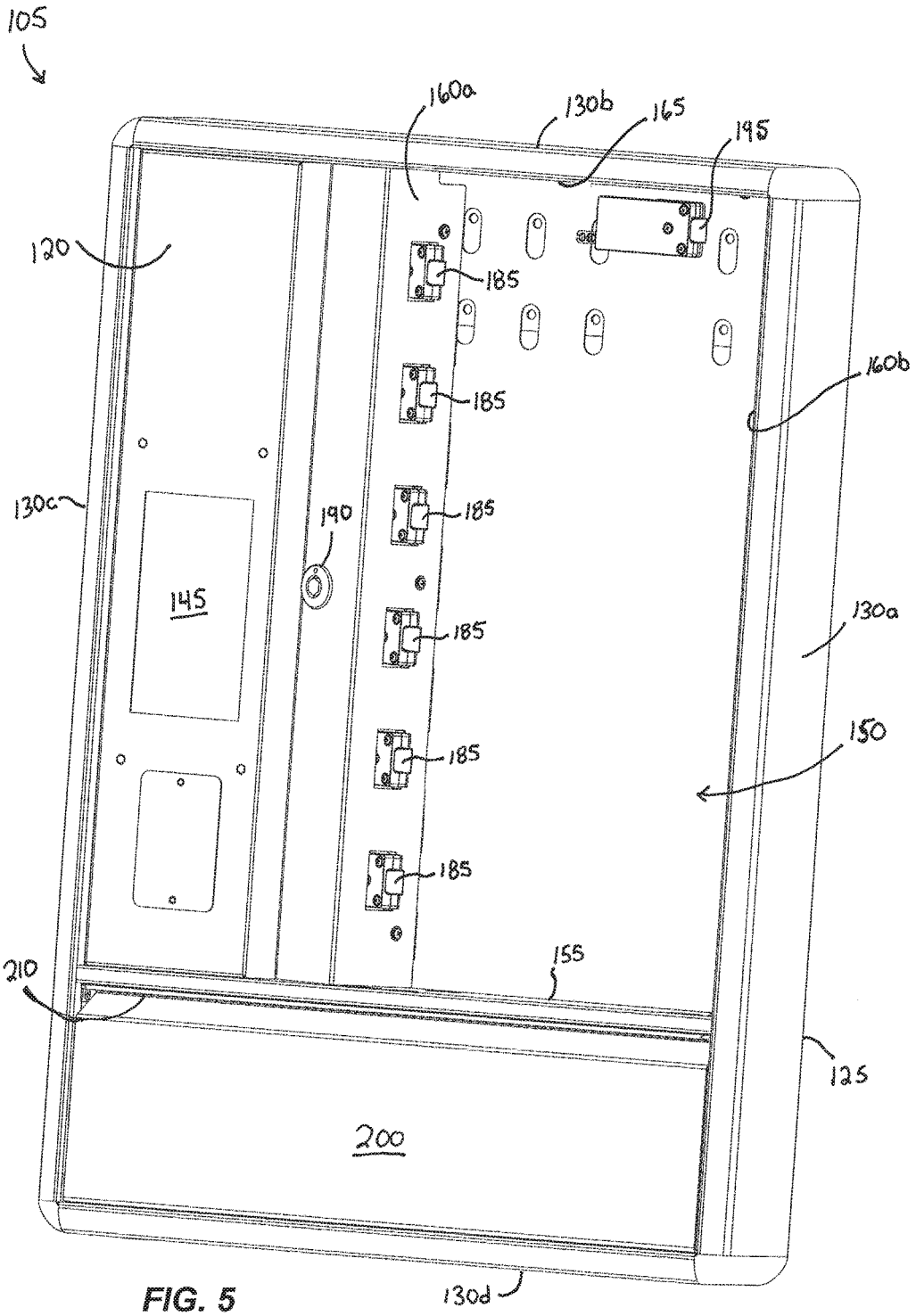
FIG. 5 is a perspective view of the base of FIG. 1.
Figure 20:
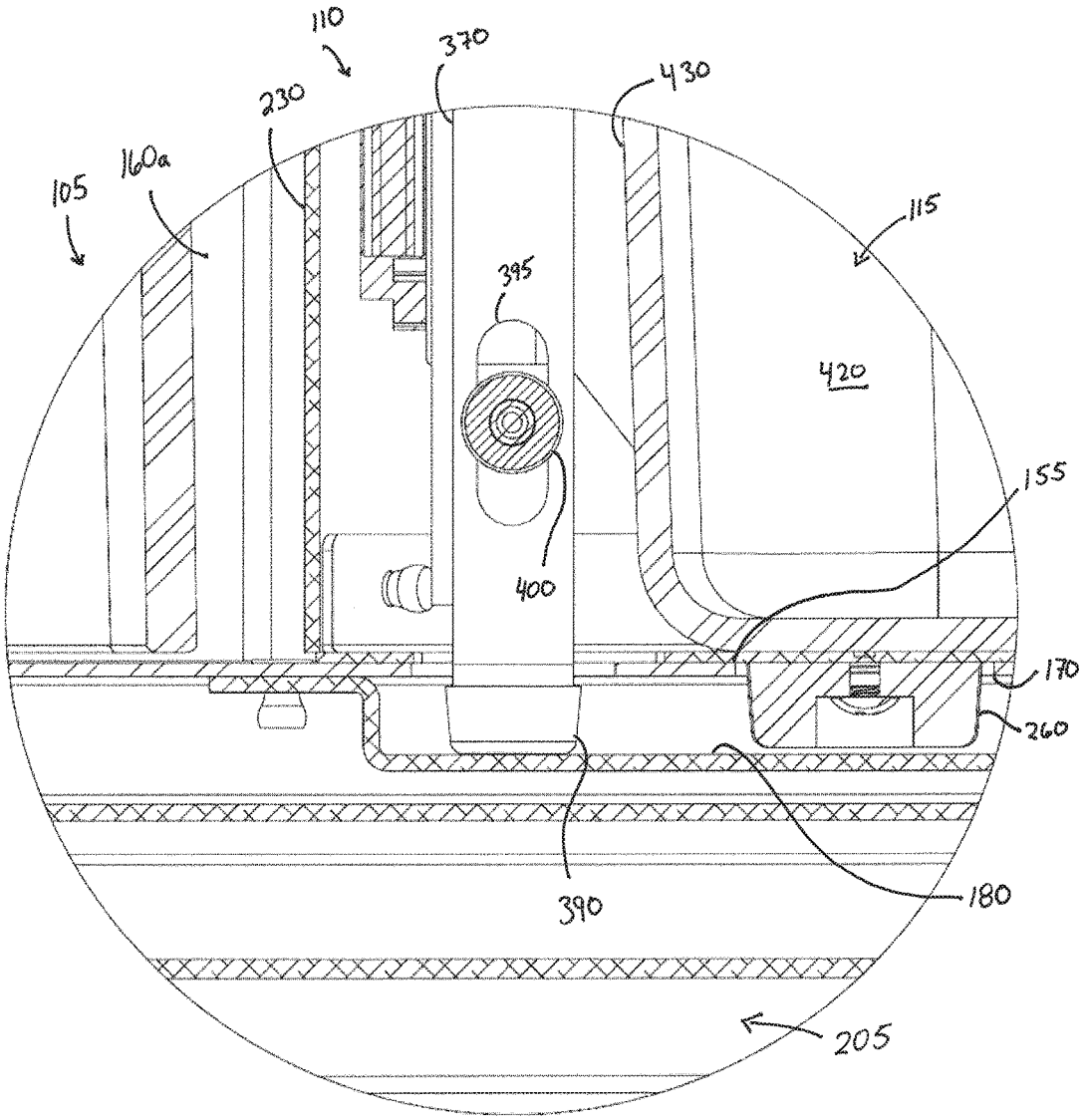
FIG. 20 illustrates engagement between a portion of the locking mechanism and the base enabling movement of the locking mechanism into the second configuration of FIG. 9.

As illustrated in FIGS. 4 and 5, the base 105 also includes a cavity 150 defined by a false bottom 155, inner side surfaces 160*a*, 160*b*, a top surface 165, and the rear side 125. The illustrated cavity 150 is sized and configured to receive the cassette 110. The false bottom 155 includes foot apertures 170 (e.g., circular apertures) and a base locking mechanism aperture 175 with a bottom surface 180 located below the foot apertures 170 and the base locking mechanism aperture 175 (FIG. 20). In the illustrated embodiment, the false bottom 155 includes four foot apertures 170 (three of which are illustrated in FIG. 4) with the base locking mechanism aperture 175 located between one of the foot apertures 170 and the inner side surface 160*a*. A plurality of storage bin locks or restraining members 185 extend from the inner side surface 160*a*. In other embodiments, the storage bin locks 185 may be coupled to the cassette 110. The illustrated inner side surface 160*a* is oriented at an angle relative to the opposing inner side surface 160*b* (e.g., the inner side surface 160*a* is angled towards the user interface 145). In other embodiments, the inner side surface 160*a* may be oriented substantially parallel to the inner side surface 160*b*. In the illustrated embodiment, the base 105 includes six storage bin locks 185; however, in other embodiments, the base 105 may include more or less than six storage bin locks 185. The illustrated storage bin locks 185 are in communication with and are controlled by the user interface 145. Furthermore, an override lock 190 is coupled to the base 105 and is configured to override the user interface 145 to operate the storage bin locks 185.

With particular reference to FIG. 5, the base 105 further includes a cassette lock 195 fixed to the rear side 125 and located adjacent the top surface 165 of the base 105 (e.g., the cassette lock 195 is positioned away from the false bottom 155). The cassette lock 195 is operable to releasably lock the cassette 110 into the base 105. The illustrated cassette lock 195 is in communication with and is controlled by the user interface 145. In other embodiments, the cassette lock 195 may be coupled to a different location with the cavity 150.

Positioned below the cavity 150 is a compartment door 200 pivotably coupled to the base 105 between an open position (FIG. 1) and a closed position (FIG. 5). The compartment door 200 is configured to provide access to a storage compartment 205 when the compartment door 200 is in the open position (FIG. 1), and the compartment door 200 blocks access to the storage compartment 205 when the compartment door 200 is in the closed position (FIG. 5). The storage compartment 205 is configured to allow storage of common medical supplies or equipment (e.g., syringes), which are not required to be secured within the storage cabinet 100. In other embodiments, the compartment door 200 may be lockable in the closed and/or open positions. The illustrated compartment door 200 includes a compartment door handle 210 to facilitate movement of the compartment door 200 between the open position (FIG. 1) and the closed position (FIG. 5). The compartment door 200 also includes an inner door surface 215 configured to provide a work support surface as the medical professional operates the storage cabinet 100 (e.g., the inner door surface 215 can support the storage bins 115 or other medical equipment).

Figure 6:
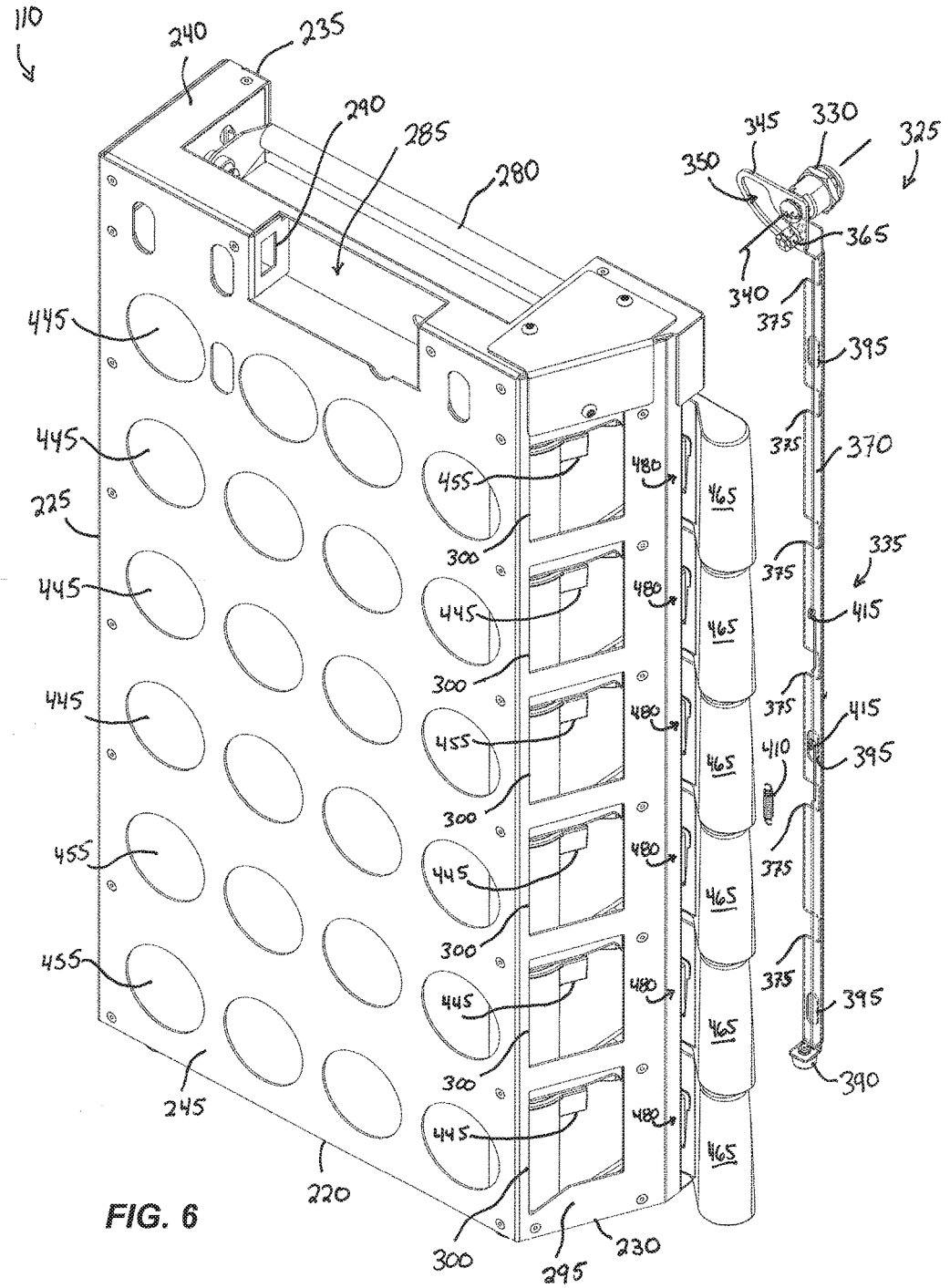
FIG. 6 is a rear partially exploded view of the cassette of FIG. 1 coupled to the plurality of storage bins.
Figure 7:
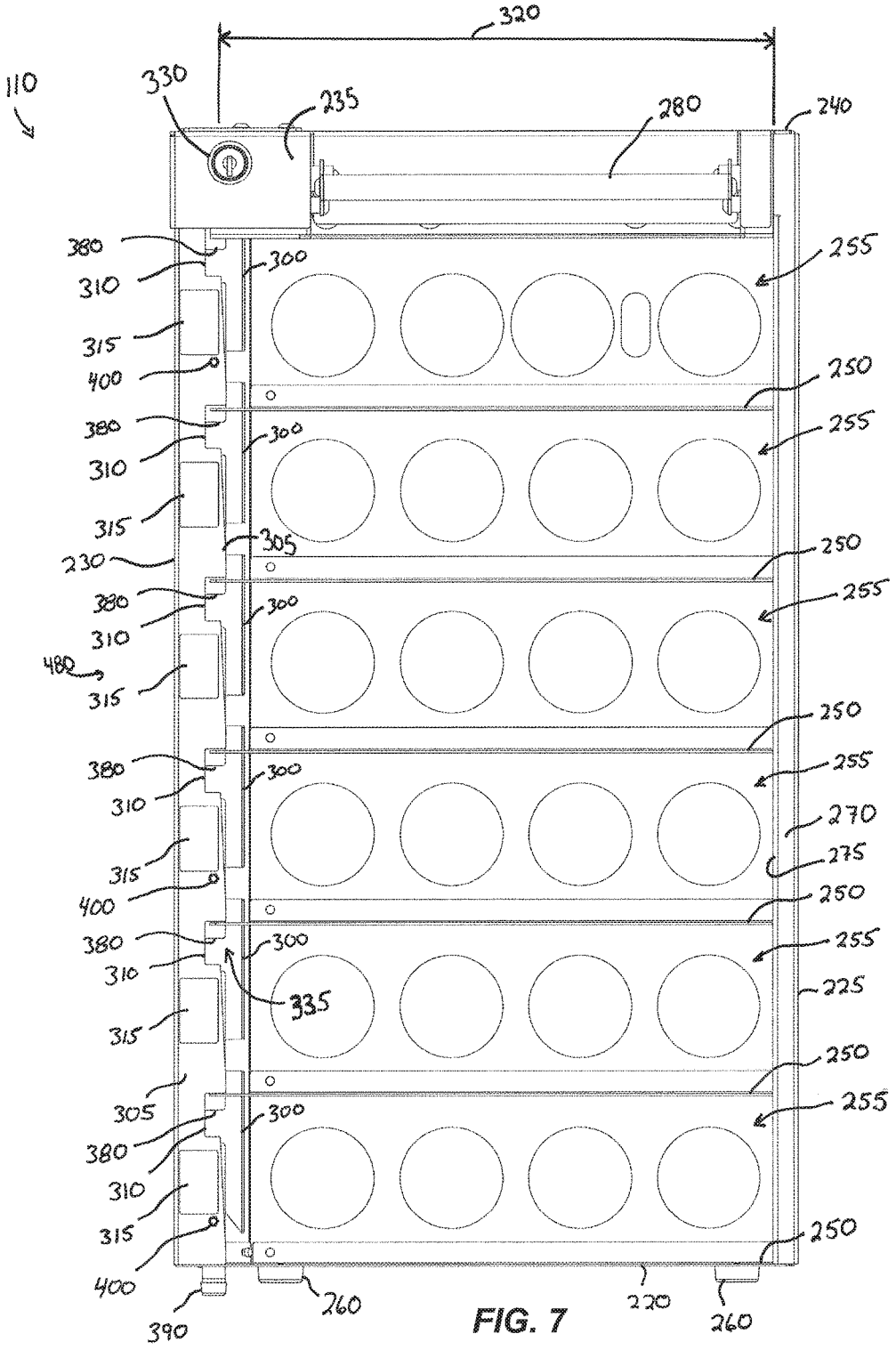
FIG. 7 is a front view of the cassette of FIG. 1 including a locking mechanism in a first configuration.

With reference to FIGS. 6 and 7, the cassette 110 includes a bottom side 220, a first side 225, a second side 230, a front side 235, a top side 240, and a back side 245. The cassette 110 also includes a plurality of shelves 250 (the bottom side 220 also defines a shelf 250) extending from the first side 225 to the second side 230 with adjacent shelves 250 defining a storage bin cavity 255 therebetween. In the illustrated embodiment, the cassette 110 includes six storage bin cavities 255; however, in other embodiments, the cassette 110 may include more or less than six storage bin cavities 255.

Figure 16:
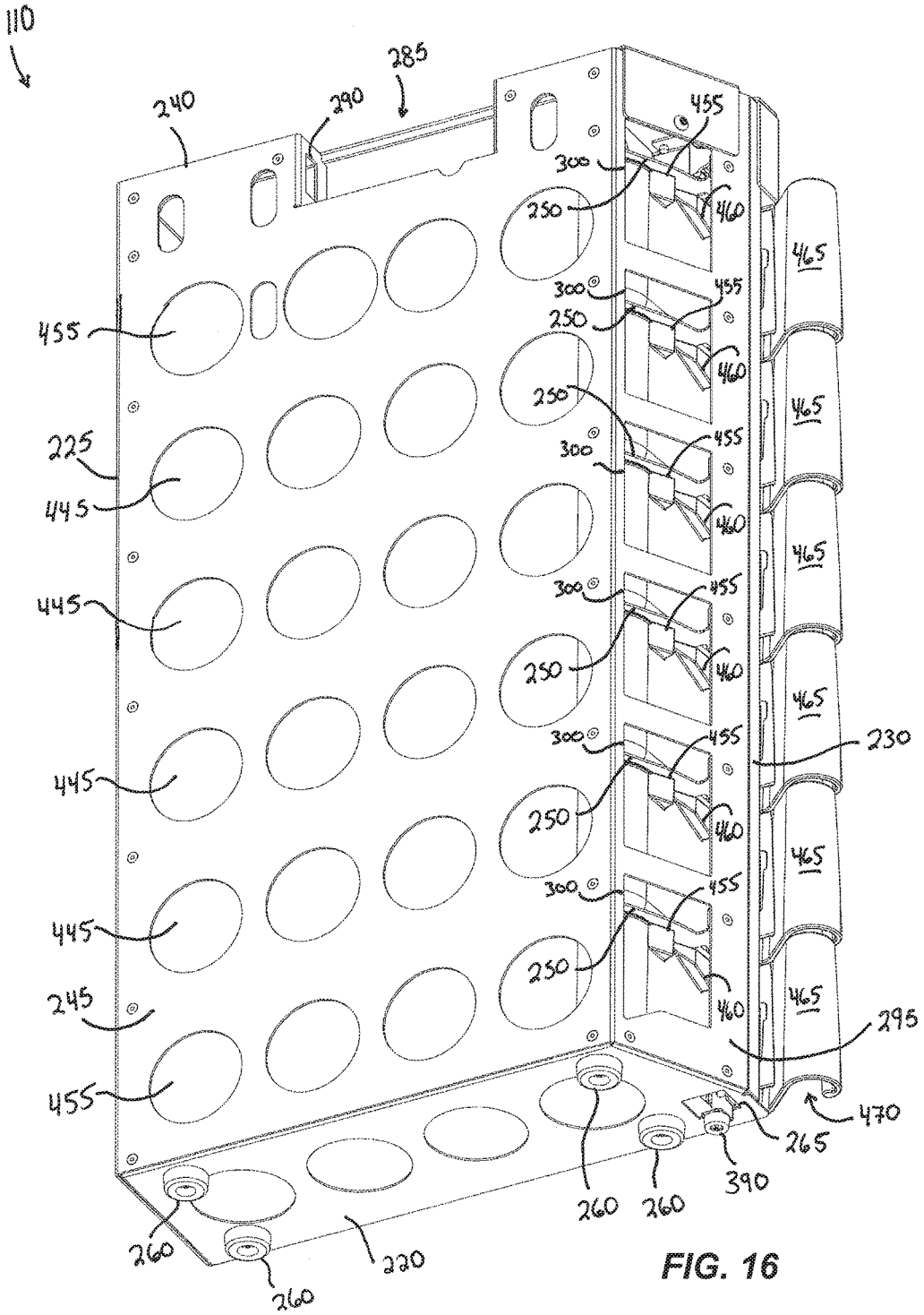
FIG. 16 is a rear view of the cassette supporting the plurality of storage bins that is removed from the base of FIG. 1.

The bottom side 220 includes feet 260 extending away from the top side 240 and a cassette locking mechanism aperture 265 (FIG. 16). The first side 225 includes a flange 270 that partially defines the front side 235 of the cassette 110 with the flange 270 extending from the first side 225 toward the second side 230 such that an edge 275 of the flange 270 is between the first side 225 and the second side 230. The illustrated flange 270 is a continuous member extending between the bottom side 220 and the top side 240 of the cassette 110 so that the flange 270 is in communication with each of the storage bin cavities 255. In other embodiments, the flange 270 may be a discontinuous member with each discrete portion in communication with a corresponding storage bin cavity 255. In further embodiments, the flange 270 may be positioned between the front side 235 and the back side 245 of the cassette 110 (e.g., the flange 270 is coupled to the shelves 250).

Located adjacent the top side 240 is a cassette handle 280 to facilitate transportation and movement of the cassette 110 by the medical professional. The cassette handle 280 generally aligns with a center of gravity of the cassette 110 in a vertical plane (e.g., the vertical plane is parallel to the back side 245) such that the cassette handle 280 enables ease of transportation of the cassette 110 by the medical professional. In addition, the relative narrow width of the cassette 110 (e.g., the distance between the front side 235 and the back side 245) allows the cassette 110 to be held adjacent the medical professional so that the center of gravity of the cassette 110, the cassette handle 280, and the medical professional's arm and hand are generally co-planar. In one embodiment, the cassette handle 280 is pivotably coupled to the cassette 110 such that the cassette handle 280 is moveable in a storage position (FIG. 6; the cassette handle 280 is positioned below the top side 240) or the cassette handle 280 is moveable in a transportable position (not shown; the cassette handle 280 extends upwardly beyond the top side 240). In other embodiments, the cassette handle 280 may be immovably fixed to the cassette 110. Located between the back side 245 and the top side 240 is a cassette lock cavity 285 in communication with cassette lock apertures 290 (one of which is shown in FIG. 6) that are sized and configured to receive the cassette lock 195.

The second side 230 includes an angled surface 295 having a plurality of storage bin apertures 300 with each storage bin aperture 300 in communication with a corresponding storage bin cavity 255. In the illustrated embodiment, the angled surface 295 is oriented relative to the first side 225 at the generally same angle that the inner side surface 160*a* of the base 105 is angled. In other embodiments, the surface 295 may be parallel to the first side 225. The front side 235 and the second side 230 includes a post or flange 305 extending between the bottom side 220 and the top side 240 and includes a plurality of slots 310 with each slot 310 corresponding to one of the storage bin cavities 255 (FIG. 7). In other words, the post 305 includes six slots 310. The illustrated post 305 also includes a plurality of magnets 315 with each magnet 315 also corresponding to one of the storage bin cavities 255. In other embodiments, the magnets 315 may be replaced with apertures, protrusions, pins, etc. In the illustrated embodiment, a cassette dimension 320 is defined between the post 305 (e.g., an edge of the post 305 closest to the flange 270) and the edge 275 of the flange 270 (FIG. 7).

Figure 8:
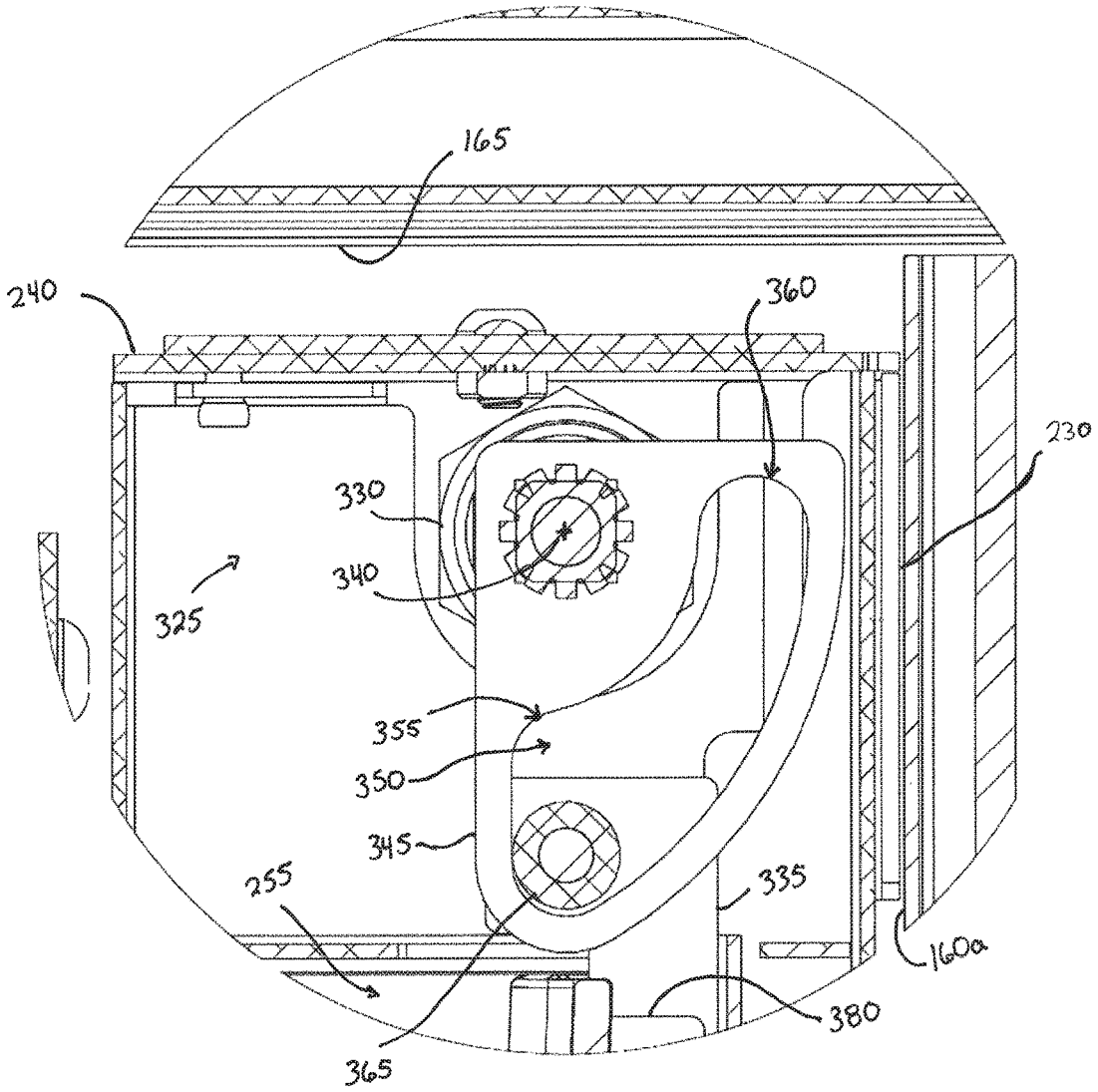
FIG. 8 is a detailed cross sectional view of the cassette of FIG. 7 illustrating a portion of the locking mechanism in the first configuration.

With continued reference to FIGS. 6 and 7, the cassette 110 also includes a locking mechanism 325 including a keyed lock 330 and a slidable locking bar 335 operable to selectively lock the storage bins 115 to the cassette 110. The keyed lock 330 is coupled to the front side 235 near the top side 240 of the cassette 110 and is moveable about a rotational axis 340 between a locked state (FIGS. 11 and 12) and an unlocked state (FIGS. 7-10). With reference to FIG. 8, a cam member 345 is rotatably fixed to the keyed lock 330 and includes an opening 350 defining a first portion 355 and a second portion 360. The illustrated opening 350 tapers in dimension from the first portion 355 to the second portion 360 (e.g., the second portion 360 includes a smaller dimension than the first portion 355).

Figure 9:
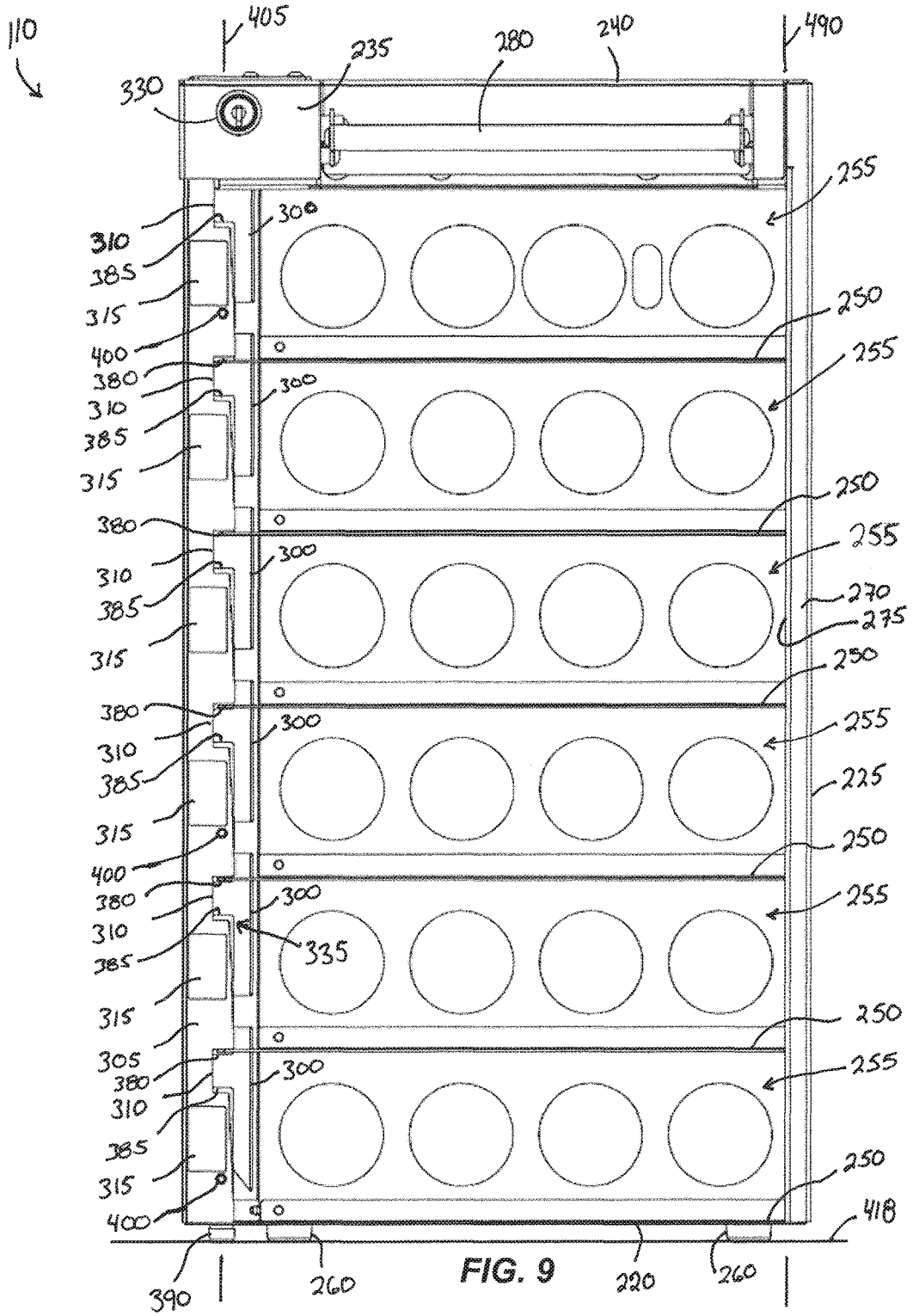
FIG. 9 is a front view of the cassette of FIG. 1 including the locking mechanism in a second configuration.

As shown in FIGS. 6 and 8, the slidable locking bar 335 includes a stud 365 that is received within the opening 350, and a body 370 having a plurality of slots 375. Each of the slots 375 of the body 370 includes a top edge 380 (FIG. 7) and a bottom edge 385 (FIG. 11) and corresponds to each of the slots 310 of the post 305. At an end of the body 370 positioned away from the stud 365 is a locking bar foot 390 that is extendable through the cassette locking mechanism aperture 265. The slots 375 of the body 370 are located between the locking bar foot 390 and the stud 365. In addition, the body 370 includes locking bar apertures 395 that each receive a fastener 400 coupled to the post 305 (FIGS. 7 and 20) to slidably couple the body 370 to the post 305 along a vertical axis 405 (FIG. 9). The body 370 is also biased downwardly (away from the top side 240) by a spring 410 engaging a hook 415 of the body 370 and a portion of the cassette 110 (e.g., the post 305).

With reference to FIGS. 7-12, the locking mechanism 325 is moveable between three configurations. A first or biased locked configuration is illustrated in FIGS. 7 and 8 to enable the biasing force of the spring 410 to move the body 370 into a locked position to inhibit removal of the storage bins 115 from the cassette 110. The biased locked configuration is defined by the cam member 345 positioned within the unlocked state (FIG. 8) such that the body 370 is allowed to be biased downwardly along the vertical axis 405 for the locking bar foot 390 to fully extend from the cassette locking mechanism aperture 265. In particular, the cam member 345 is rotated about the rotational axis 340 such that the stud 365 is positioned within the first portion 355 of the cam member 345. Accordingly, the spring 410 biases the body 370 downwardly such that the top edge 380 of the slots 375 of the body 370 are positioned within the slots 310 of the post 305 (FIG. 7) to provide interference between the storage bins 115 and the slidable locking bar 335 inhibiting removal of the storage bins 115 from the cassette 110.

Figure 10:
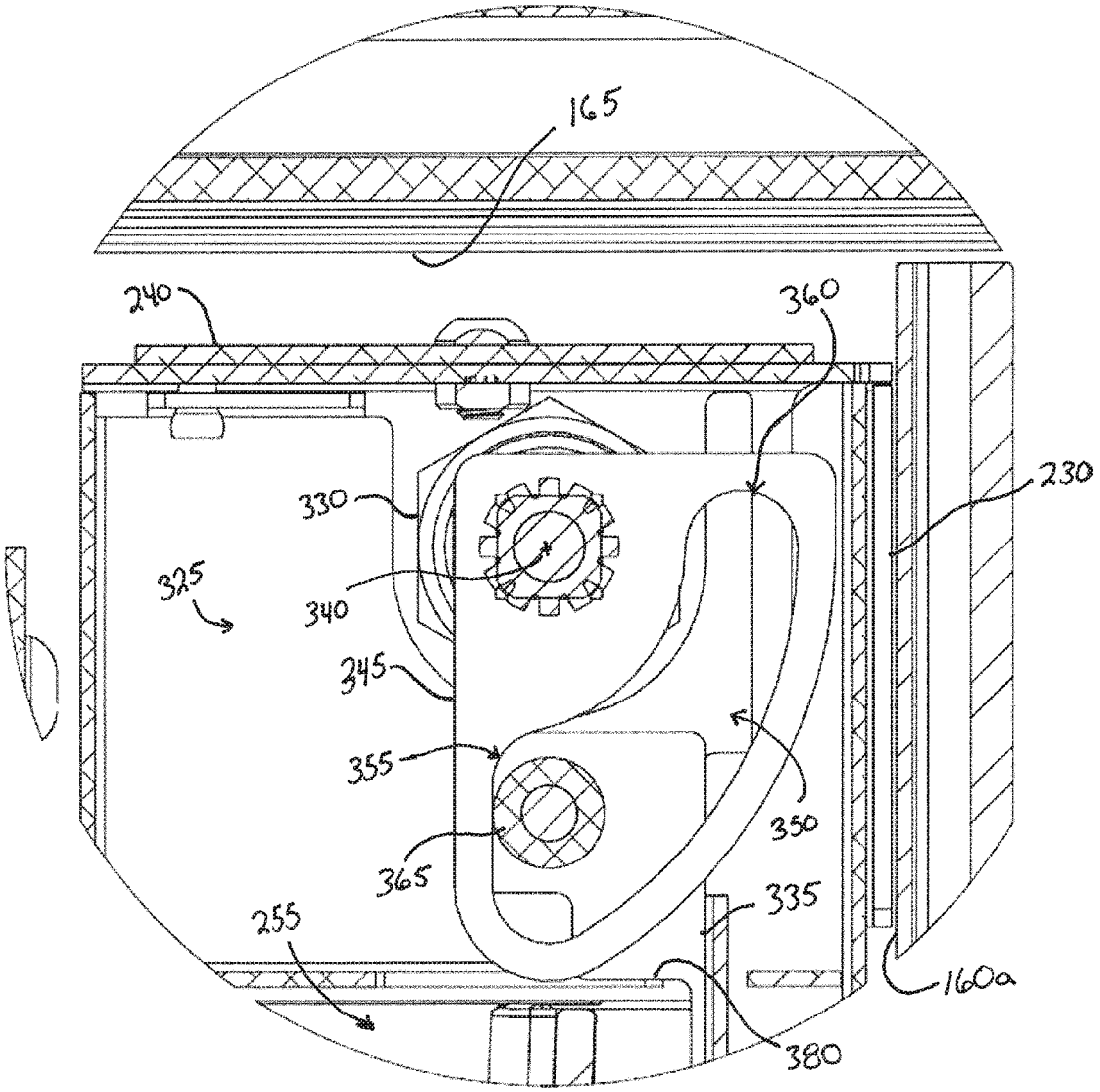
FIG. 10 is a detailed cross sectional view of the cassette of FIG. 9 illustrating a portion of the locking mechanism in the second configuration.

A second or biased unlocked configuration is illustrated in FIGS. 9 and 10 to enable removal or insertion of the storage bins 115 from the cassette 110. The biased unlocked configuration is defined by the cam member 345 also positioned within the unlocked state (FIG. 10). However, the stud 365 is able to move along the vertical axis 405 within the first portion 355 of the cam member 345 (e.g., towards the keyed lock 330), for example, if a force is applied to the slidable locking bar 335 in a direction against the biasing direction of the spring 410. Such a force may result from supporting the cassette 110 on a support surface 418 (e.g., a table) with the locking bar foot 390 engaging the support surface 418 (e.g., the locking bar foot 390 is co-planar with a bottom of the feet 260). As such, the locking bar foot 390 is pushed toward the bottom side 220 of the cassette 110 thereby positioning the top edge 380 and the bottom edge 385 of the slots 375 of the body 370 in substantial alignment with the slots 310 of the post 305 (FIG. 9) to provide clearance between the storage bins 115 and the slidable locking bar 335 enabling removal or insertion of the storage bins 115 from the cassette 110.

Figure 11:
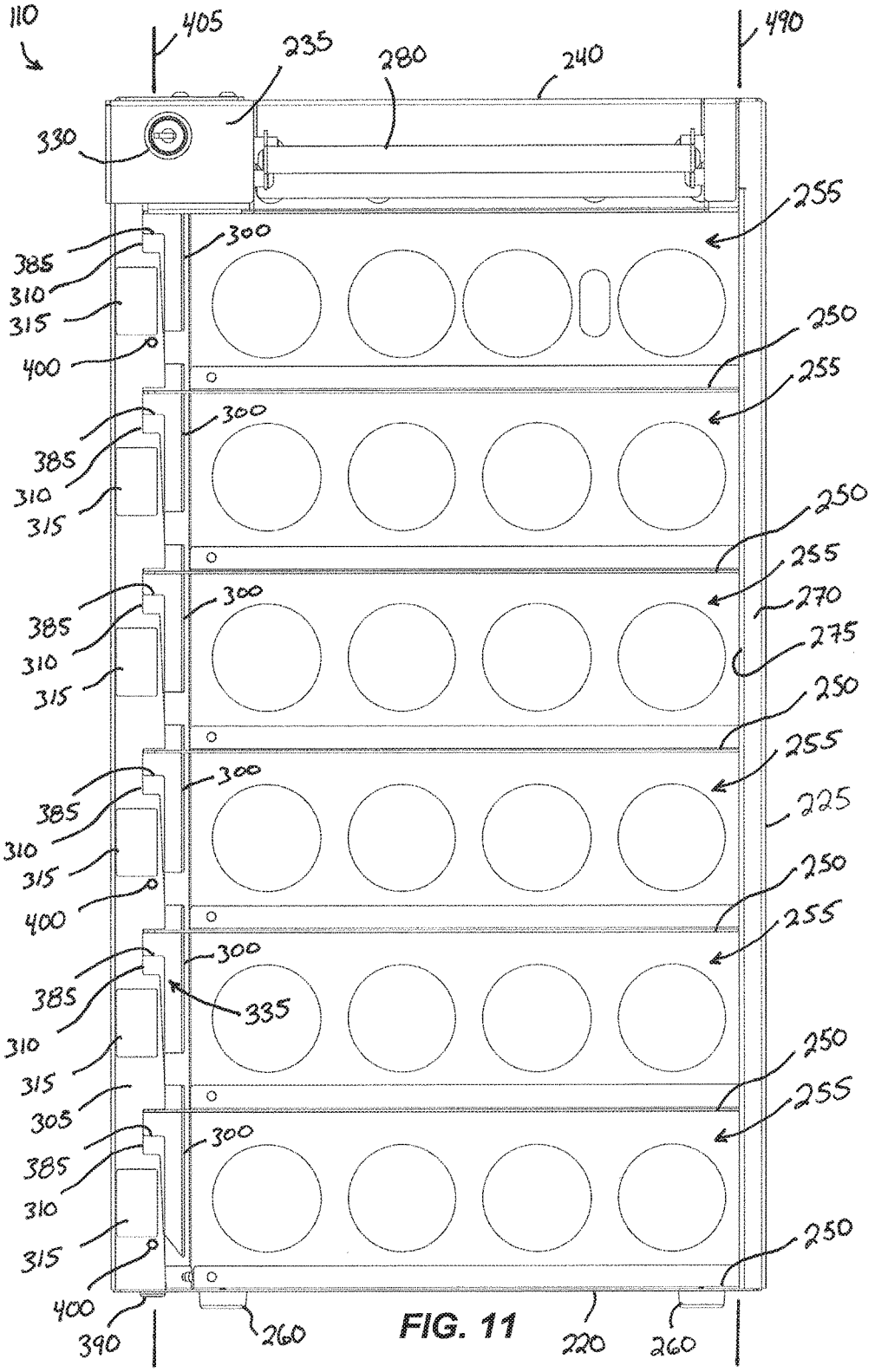
FIG. 11 is a front view of the cassette of FIG. 1 including the locking mechanism in a third configuration.
Figure 12:
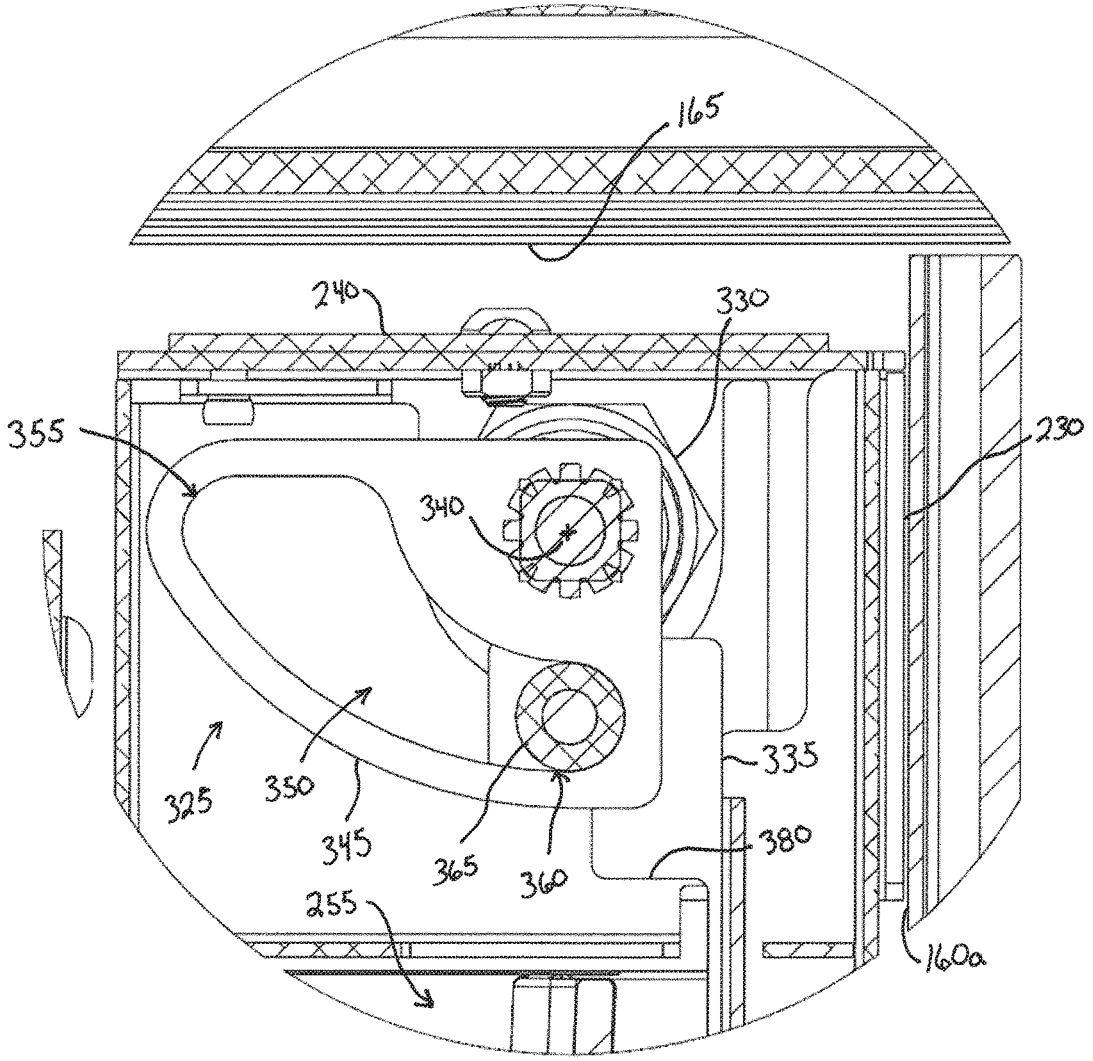
FIG. 12 is a detailed cross sectional view of the cassette of FIG. 11 illustrating a portion of the locking mechanism in the third configuration.

A third or keyed lock configuration is illustrated in FIGS. 11 and 12 to enable the storage bins 115 to be secured within the cassette 110 by operating the keyed lock 330. The keyed lock configuration is defined by the cam member 345 positioned within the locked state (FIG. 12) such that the stud 365 slides into the second portion 360 of the cam member 345. In the illustrated embodiment, the second portion 360 is radially closer to the rotational axis 340 than the first portion 355 such that the stud 365 and the body 370 move toward the keyed lock 330 against the biasing direction of the spring 410. As such, the bottom edges 385 of the slots 375 of the body 370 are positioned within the slots 310 of the post 305 (FIG. 11) to provide interference between the storage bins 115 and the slidable locking bar 335 inhibiting removal of the storage bins 115 from the cassette 110. In addition, in one embodiment, the locking bar foot 390 is generally flush with the bottom side 220 of the cassette 110.

Figure 13:
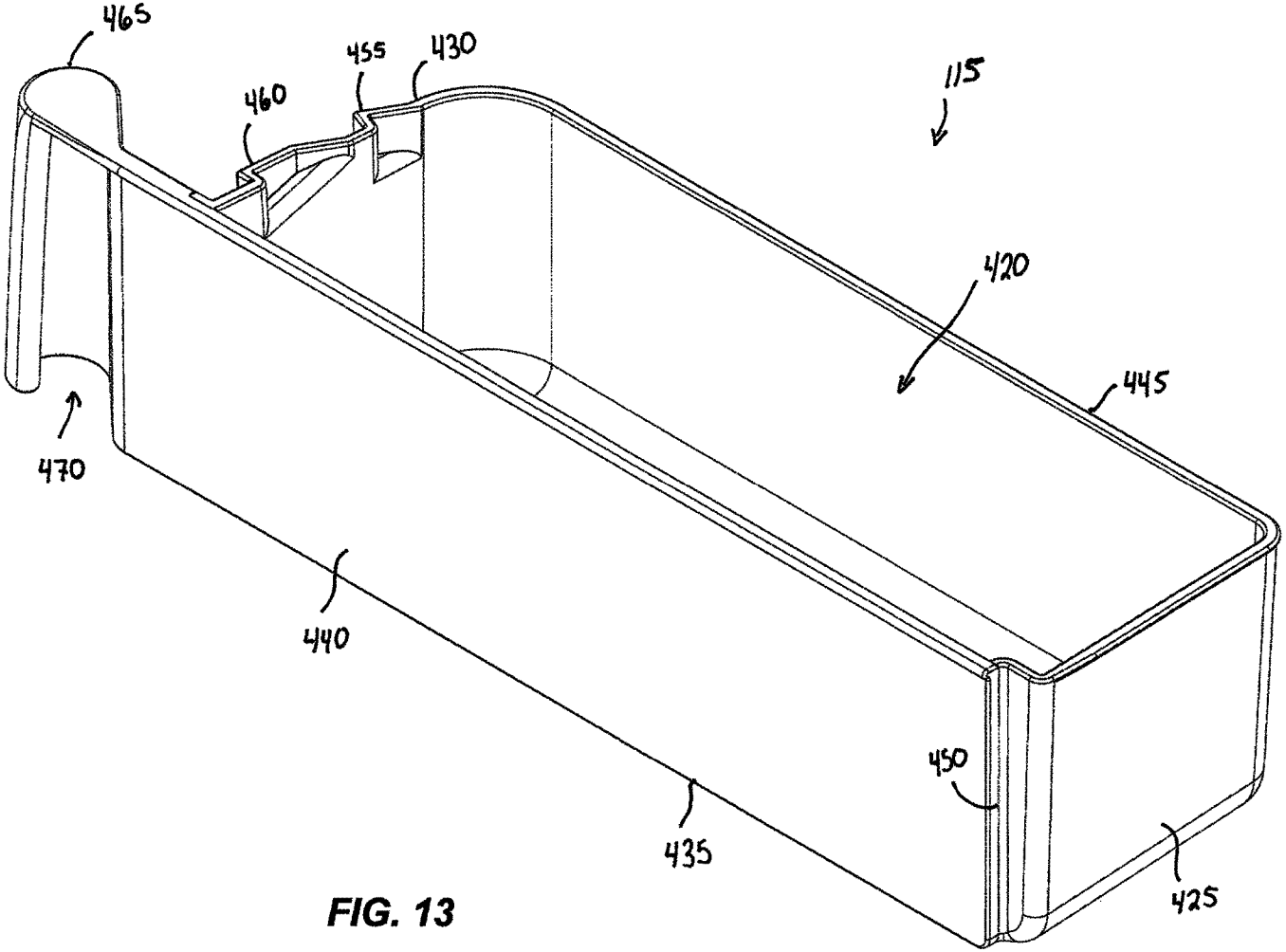
FIG. 13 is a perspective view of one of the plurality of storage bins of FIG. 1.
Figure 14:
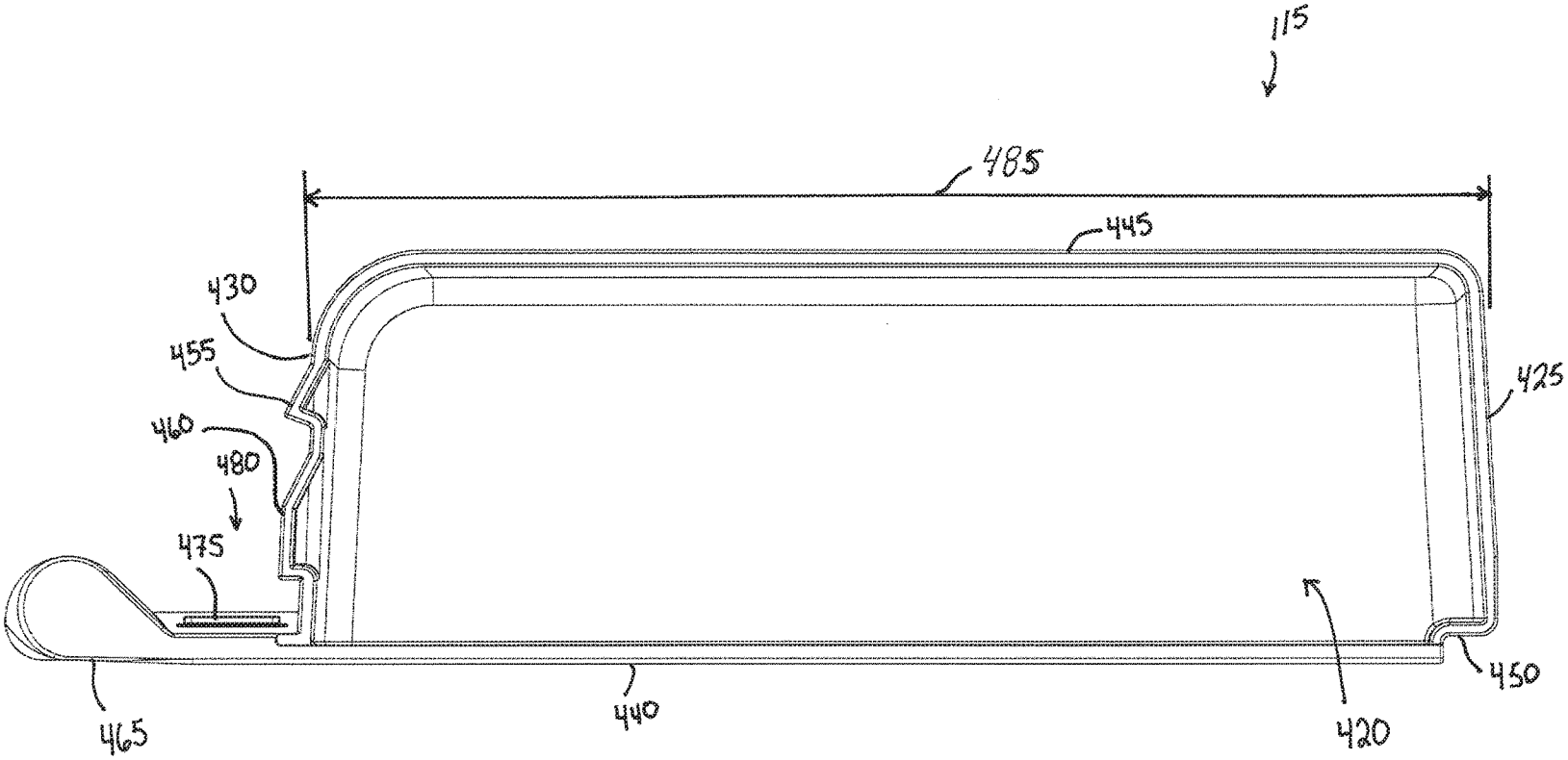
FIG. 14 is a top view of the storage bin of FIG. 13.

With reference to FIGS. 13 and 14, each of the storage bins 115 includes a storage cavity 420 defined by a first side 425, a second side 430, a bottom side 435, a front side 440, and a back side 445. Each of the storage bins 115 also includes a notch 450 located at an interface between the front side 440 and the first side 425. In other embodiments, the notch 450 may be located on the first side 425 between the front side 120 and the back side 445 of the storage bins 115. The second side 430 includes a base locking protrusion 455 and a slidable bar locking protrusion 460 each extending away from the first side 425. The base locking protrusion 455 is configured to interact with the storage bin locks 185, and the slidable bar locking protrusion 460 is configured to interact with the slidable locking bar 335. In other embodiments, the base locking protrusion 455 and the slidable bar locking protrusion 460 may be positioned anywhere on the second side 430. The illustrated slidable bar locking protrusion 460 is located between the base locking protrusion 455 and the front side 440. The storage bins 115 further include a handle 465 coupled to the second side 430 and extending away from the first side 425. In other embodiments, the handle 465 may be coupled to the first side 425. The illustrated handle 465 is configured to be gripped by either a left or right hand of a medical professional to maneuver the storage bins 115. For example, the handle 465 includes an opening 470 configured to be gripped by the right hand of the medical professional. Alternatively, the curved outer peripheral surface of the handle 465 is contoured to be grasped by the left hand of the medical professional. The handle 465 also includes a magnet 475 (FIG. 14) facing toward the back side 445 of the storage bin 115. The magnet 475 is configured to engage with the magnet 315 located on the post 305 with such an engagement between the magnets 315, 475 defining a biasing arrangement 480 operable to bias the bins 115 into releasable engagement with the cassette 110. In other embodiments, the magnet 475 may be a resilient pin that engages the aperture formed within the post 305. In the illustrated embodiment, a storage bin dimension 485 is defined between the first side 425 and the second side 430 (FIG. 14) with the storage bin dimension 485 being greater than the cassette dimension 320 (FIG. 7).

Figure 15:
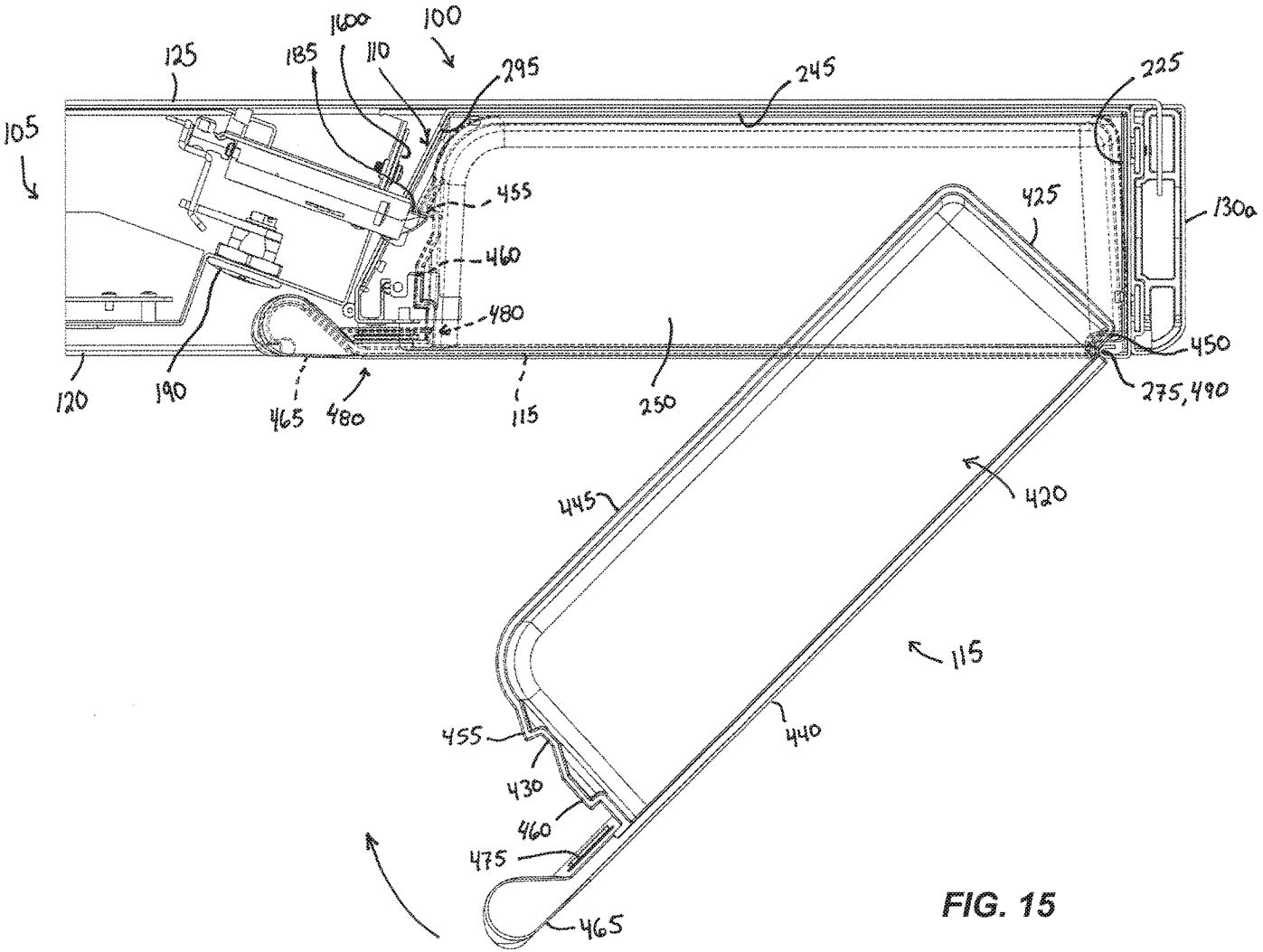
FIG. 15 illustrates one of the plurality of storage bins of FIG. 1 pivotably coupled to the cassette.

FIG. 15 illustrates one of the storage bins 115 being assembled to the cassette 110, which is the same as how any of the plurality of storage bins 115 are assembled to the cassette 110. During insertion of the storage bin 115 into the cassette 110, the bottom side 435 of the storage bin 115 slidably engages the shelf 250 and the notch 450 and the flange 270 engage so that the storage bin 115 is rotated into the respective storage bin cavity 225 until the back side 445 of the storage bin 115 abuts the back side 245 of the cassette 110 and the first side 425 of the storage bin 115 abuts the first side 225 of the cassette 110. In particular, the flange 270 also defines a pivot axis 490 about which the storage bin 115 pivots relative to the cassette 110 during insertion or removal of the storage bin 115. Stated another way, the corner of the storage bin 115 between the first side 425 and the back side 445 is inserted into a respective storage bin cavity 255, the bottom side 435 slides along the shelf 250 for the notch 450 to be hooked behind the flange 270, and then the storage bin 115 is pivoted about the pivot axis 490 into the respective storage bin cavity 255. The pivotable arrangement between the storage bin 115 and the cassette 110 enables proper insertion of the storage bin 115 into the cassette 110 (e.g., incorrect insertion of the storage bin 115 into the cassette 110 is inhibited). In particular, the storage bin 115 is inhibited from axial insertion or removal from the cassette 110 because the storage bin dimension (e.g., a first dimension) 485 is greater than the cassette dimension (e.g., a second dimension) 320. In other words, the storage bin dimension 485 is greater than the cassette dimension 320 inhibiting movement in a direction normal to the dimensions 320, 485 of the storage bin 115 relative to the storage bin cavity 255 of the cassette 110 when the storage bin 115 is positioned within or removed from the storage bin cavity 255. The pivotable arrangement between the storage bin 115 and the cassette 110 also enables easy access of the storage bin 115 from the front side 120 of the base 105. The relative size and shape of the storage bin cavity 255 and the storage bin 115 requires the storage bin 115 to be pivoted into and out of the storage bin cavity 255. In other embodiments, during insertion of the storage bin 115 into the cassette 110, the bottom side 435 of the storage bin 115 slidably engages the shelf 250 until the back side 445 of the storage bin 115 abuts the back side 245 of the cassette 110 and the first side 425 of the storage bin 115 abuts the first side 225 of the cassette 110. The storage bin 115 is then pivoted into a respective storage bin cavity 255 by engagement of the notch 450 and the flange 270.

As the back side 445 of the storage bin 115 approaches the back side 245 of the cassette 110, the biasing arrangement 480 biases the front side 440 of the storage bin 115 into a generally flush arrangement with the front side 235 of the cassette 110. An audible "click" might be heard when the magnets 475 and 315 engage. In other embodiments, the biasing arrangement 480 provides a positive engagement between the storage bin 115 and the cassette 110 to signify that the storage bin 115 is fully inserted within the cassette 110. The biasing arrangement 480 also temporarily holds the storage bin 115 within the cassette 110 to inhibit unintentional removal of the storage bin 115 from the cassette 110.

In operation, the illustrated storage cabinet 100 securely stores pharmaceuticals and/or medical supplies near hospital patients' rooms (e.g., on the wall 135 of a hallway or room). This location of the storage cabinet 100 enables medical professionals to retrieve individual patients' medication from the storage cabinet 100 for administration to the patients rather than having the medical professionals retrieve the medication from a centralized medication room, which is typically further from the patients' rooms. This also enables the medical professionals to devote more direct engagement with the patient rather than spending time walking back and forth between the centralized medication room and the patients' room.

Figure 17:
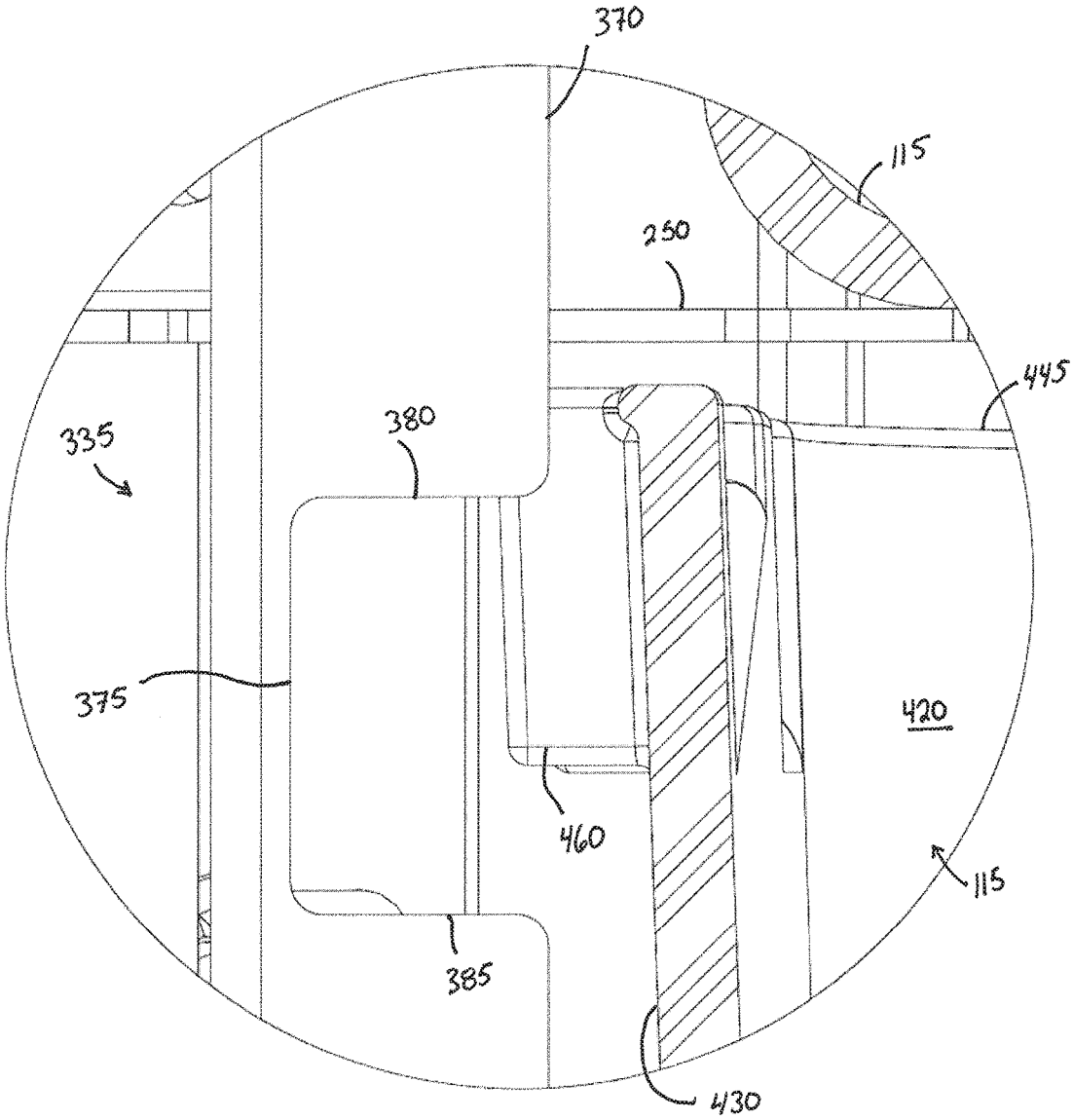
FIG. 17 illustrates engagement between a portion of the locking mechanism and one of the plurality of storage bins when the locking mechanism is in the first configuration of FIG. 7.

In order to fill each storage bin 115 with the proper medications for each patient, the cassette 110 supporting the storage bins 115 can be separated from the base 105 and carried by the cassette handle 280 to the centralized medication room. In particular, the medical professional operates the user interface 145 to actuate the cassette lock 195 into an unlocked position (e.g., disengagement between the cassette lock 195 and the cassette lock apertures 290) and to actuate the storage bin locks 185 into an unlocked position (e.g., disengagement between the storage bin locks 185 and the base locking protrusion 455) to pivot the cassette 110 out of the cavity 150 using the cassette handle 280. In one embodiment, actuation of the cassette lock 195 into the unlocked position by the user interface 145 will automatically actuate the storage bin locks 185 into the unlocked position. After the cassette 110 is removed from the cavity 150, the locking mechanism 325 automatically moves into the first configuration (FIG. 7, 16, 17) unless the cassette 110 is in the third configuration (FIGS. 11 and 12), whereby the cassette 110 is maintained in the third configuration by the keyed lock 330 and the cam member 345. When the cassette 110 is being manually transported to the centralized medication room, the locking bar foot 390 is biased to the fully extended position out of the cassette locking mechanism aperture 265 (FIGS. 7 and 16) by the spring 410. With reference to FIG. 17, the top edges 380 of each of the slots 375 on the slidable locking bar 335 align with a corresponding slidable bar locking protrusion 460 on a respective bin 115 such that portions of the body 370 are in engagement with each of the slidable bar locking protrusions 460. Accordingly, the storage bins 115 are locked and maintained within the cassette 110 during transportation of the cassette 110 to the centralized medication room. In other words, the engagement of the slidable locking bar 335 and the slidable bar locking protrusion 460 of the bins 115, as well as the engagement between the flange 270 and the notch 450, inhibits removal of the storage bins 115 from the cassette 110.

In some embodiments, one or more cassettes 110 may be transported to the centralized medication room by a cart. In this embodiment, the cassettes 110 are supported on a wheeled cart such that the body 370 maintains engagement with the storage bins 115 (FIG. 17). For example, the wheeled cart includes the false bottom 155 and the bottom surface 180 of the base 105 with the locking bar foot 390 received through the false bottom 155 via the base locking mechanism aperture 175. As such, the locking mechanism 325 is positionable within the first configuration (FIGS. 7, 8, 16, and 17).

Figure 18:
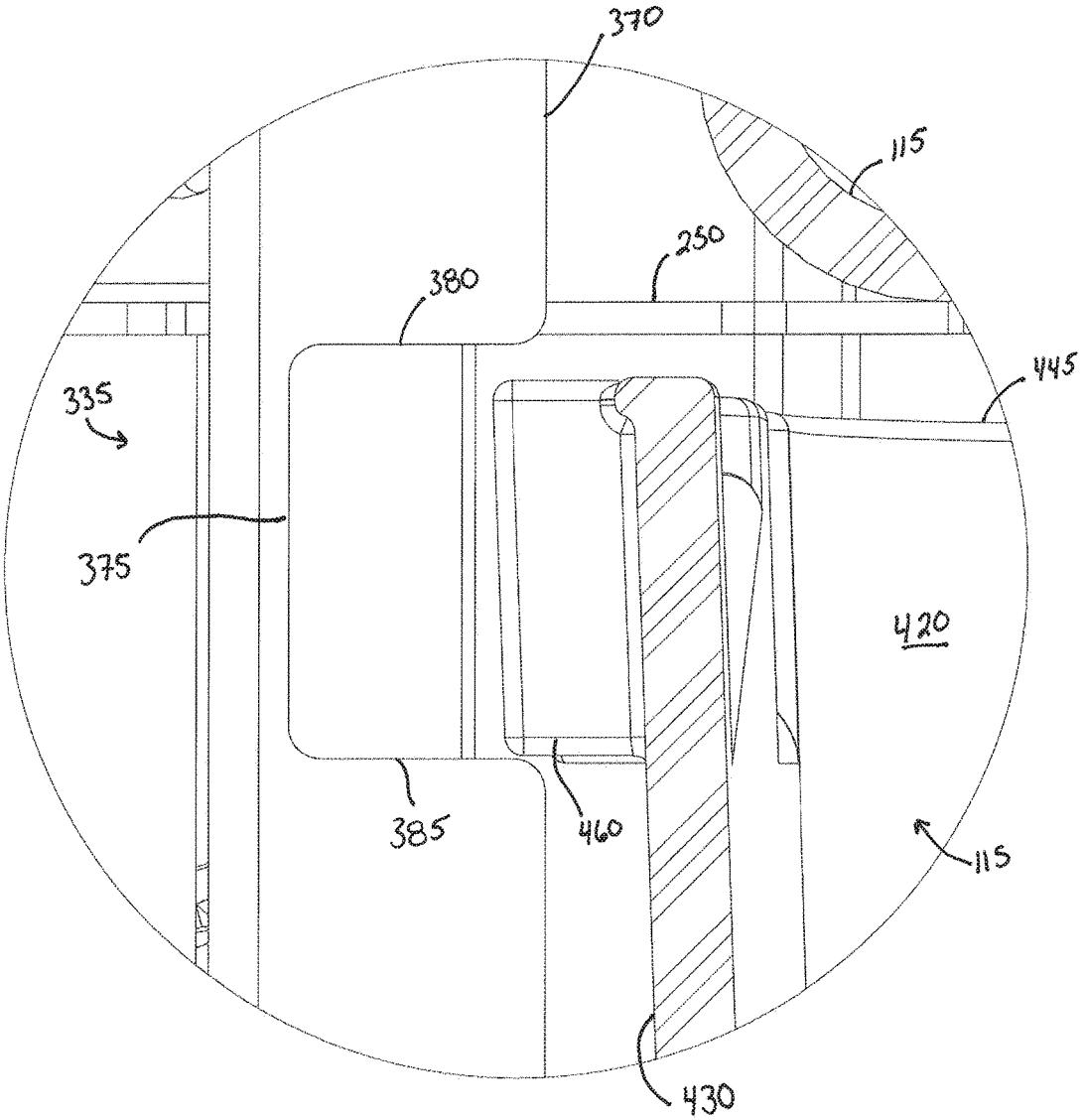
FIG. 18 illustrates a portion of the locking mechanism positioned relative to one of the plurality of storage bins when the locking mechanism is in the second configuration of FIG. 9.

Once the cassette 110 reaches the centralized medication room and is in the biased locked configuration (FIGS. 7, 8, 16, and 17), the cassette 110 is placed on a support surface (e.g., the support surface 418; FIG. 9) in order for the storage bins 115 to be removed from the cassette 110. In particular, the locking bar foot 390 engages the support surface 418 to align with a bottom surface of the feet 260 to move the locking mechanism 325 into the second, biased unlocked configuration (FIGS. 9, 10, and 18). With reference to FIG. 18, the slidable bar locking protrusions 460 then align with the slots 375 of the body 370 so that the storage bins 115 can be pivotably removed from the cassette 110, as described above, to fill each of the storage bins 115 with the appropriate medications.

Figure 19:
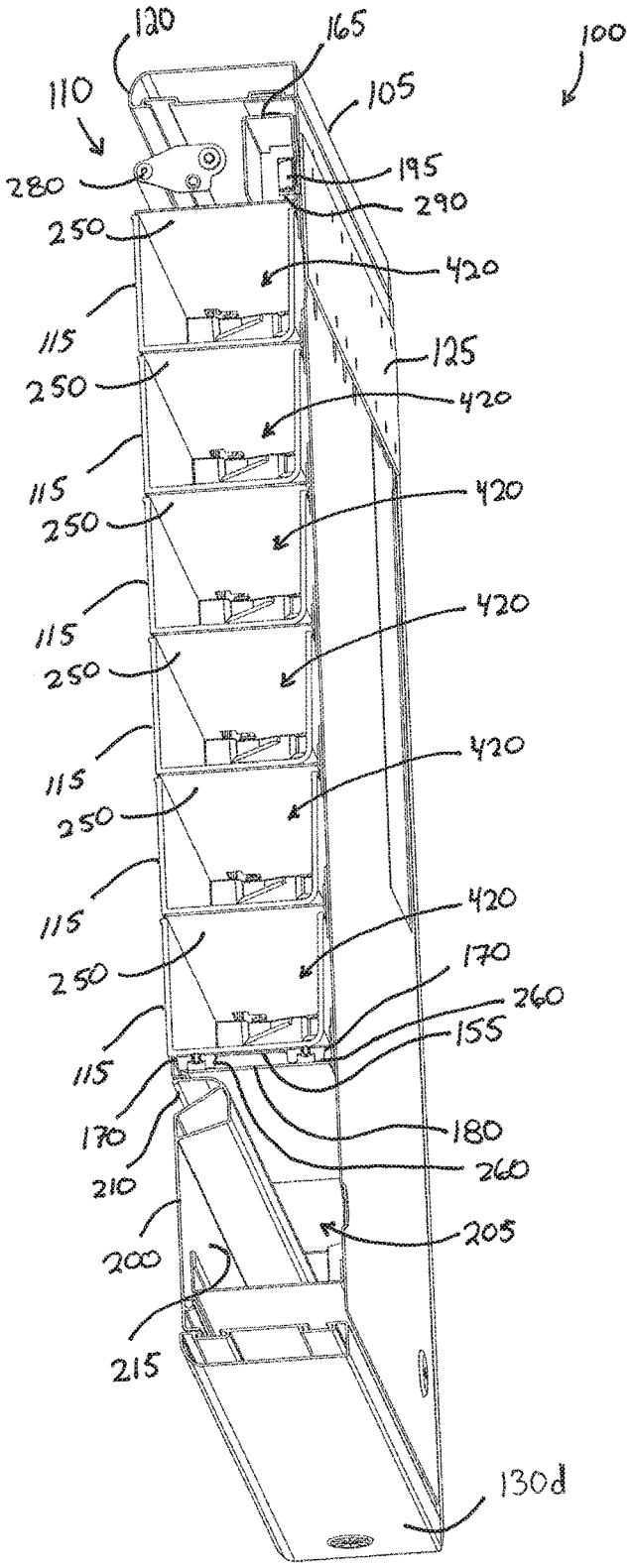
FIG. 19 is a cross sectional view of FIG. 1 taken along 19-19.

With the bins 115 filled and replaced into the cassette 110, the cassette 110 is then transported back to the base 105 from the centralized medication room with the locking mechanism 325 biased back into the first, biased locked configuration (FIGS. 7, 8, 16, and 17). With reference to FIG. 19, the cassette 110 supporting the filled storage bins 115 is coupled to the base 105 with the feet 260 of the cassette 110 received within the foot apertures 170. As such, the bottom side 220 of the cassette 110 engages the false bottom 155 of the base 105, but the feet 260 are spaced from the bottom surface 180. In another embodiment, the feet 260 engage the bottom surface 180 of the base 105 when the cassette 110 is coupled to the base 105. The illustrated cassette 110 is inserted within the cavity 150 by inserting the front feet 260 (e.g., the feet 260 adjacent the front side 235) within the respective foot apertures 170 and then pivoting the cassette 110 into the cavity 150 toward the top surface 165 (e.g., a pivot axis perpendicular to the vertical axis 405) so that the cassette locking mechanism aperture 265 receives the cassette lock 195. In other embodiments, the cassette 110 is pivoted into the cavity 150 toward one of the inner side surfaces 160*a*, 160*b* (e.g., a pivot axis parallel to the vertical axis 405). In this embodiment, the cassette 110 and the base 105 may include a similar arrangement to the flange 270 and the storage bins 115 (e.g., the base 105 may include a flange that engages a portion of the cassette 110 to secure the cassette 110 to the base 105). When the illustrated cassette 110 is coupled to the base 105, the locking bar foot 390 is biased into engagement with the bottom surface 180 of the base 105 (FIG. 20). As such, the locking mechanism is moved back into the second, biased unlocked configuration (FIGS. 9, 10, 18, and 20). In order for the cassette 110 to be securely locked to the base 105, the cassette 110 is moved into engagement with the cassette lock 195 (e.g., the cassette lock 195 is received through the cassette lock apertures 290; FIG. 19). In other words, the cassette 110 is automatically secured to the base 105 by manual insertion of the cassette 110 into the base 105 (e.g., the medical professional does not unlock the cassette lock 195 by the user interface 145 in order to insert the cassette 110 into the base 105, nor does the medical professional lock the cassette lock 195 by the user interface 145 after installation of the cassette 110).

Moreover, in order to securely lock the storage bins 115 to the base 105, the base locking protrusions 455 are moved into engagement with the storage bin locks 185 (FIG. 15). For example, the storage bins 115 are automatically secured to the base 105 by manual insertion of the cassette 110 into the base 105 (e.g., the medical professional does not unlock the bin locks 185 by the user interface 145 in order to insert the cassette 110 into the base 105, nor does the medical professional lock the storage bin locks 185 by the user interface 145 after installation of the storage bins 115). By securing the storage bins 115 to the base 105 by two locking points (e.g., engagement between the flange 270 and the notch 450 and engagement between the storage bin locks 185 and the base locking protrusions 455 or engagement between the slidable bar body 370 and slidable bar locking protrusion 460), the storage bins 115 are inhibited to be pried from (e.g., leveraged out of) the base 105 and/or the cassette 110. In the illustrated embodiment, the medical professional can actuate individual storage bin locks 185 to selectively lock one or more of the storage bins 115 to the base 105. As such, the medical professional can unlock a first storage bin 115 from the base 105 to be transported to a first patient for administration of the medication within the first storage bin 115 to the first patient. After care is given to the first patient, the medical professional returns to the storage cabinet 100 to pivotably insert the empty first storage bin 115 back into the cassette 110, and the medical professional can unlock a second storage bin 115 from the base 105 to be transported to a second patient for administration of the medication within the second storage bin 115 to the second patient. Such an operation reduces the time spent obtaining different medication for different patients.

Figure 21:
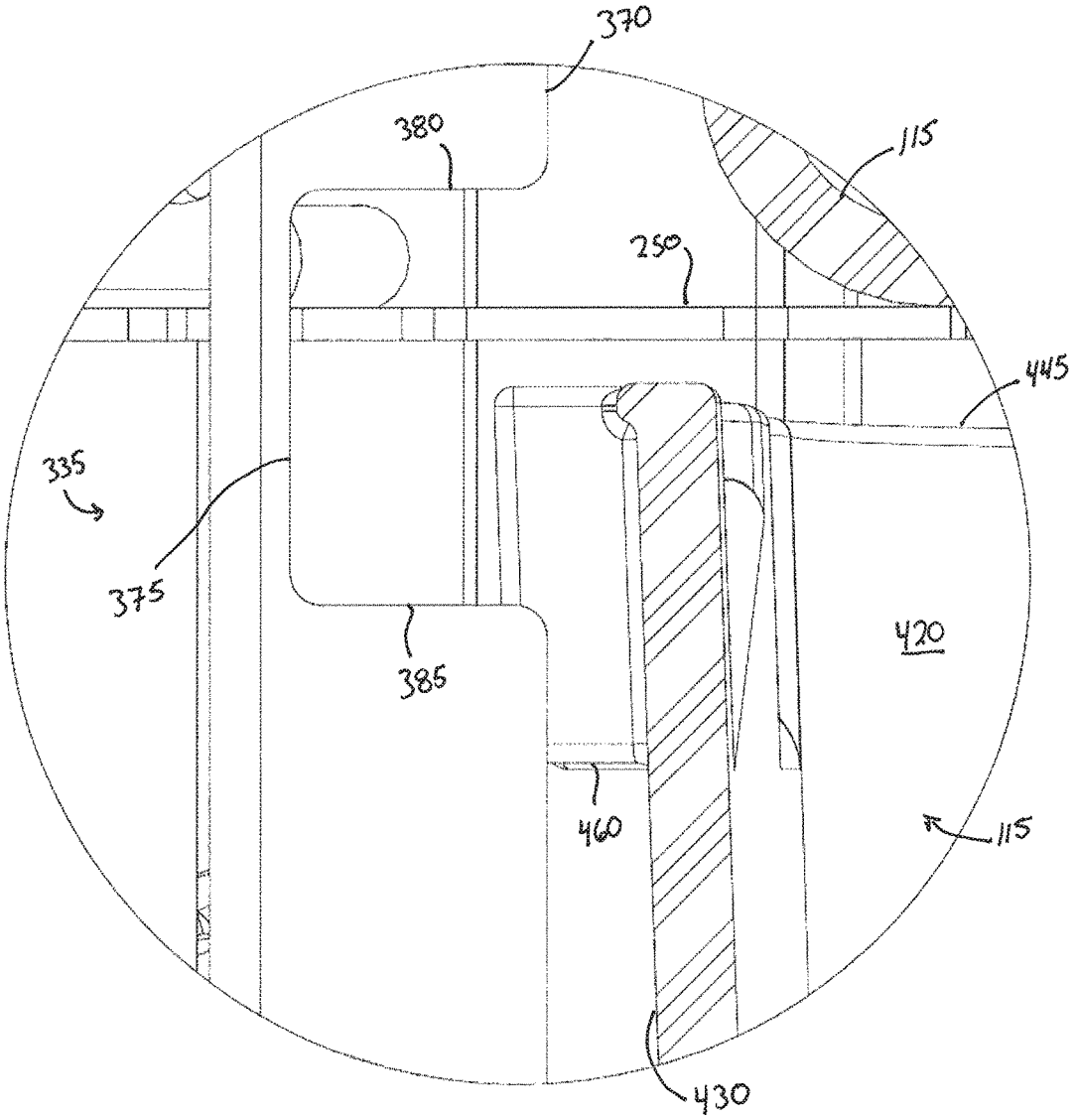
FIG. 21 illustrates engagement between a portion of the locking mechanism and one of the plurality of storage bins when the locking mechanism is in the third configuration of FIG. 11.
Figure 22:
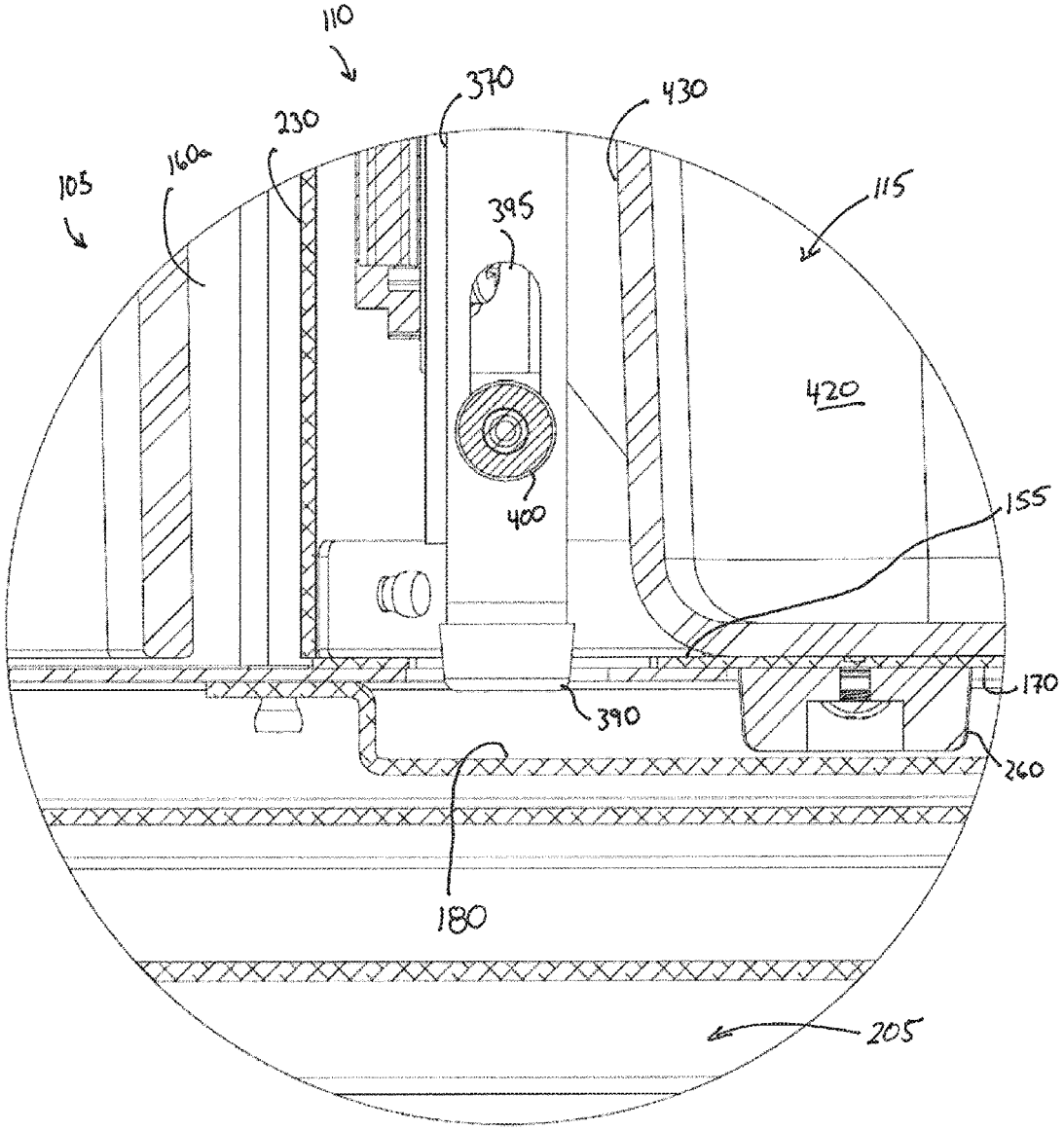
FIG. 22 illustrates a portion of the locking mechanism positioned relative to the base when the locking mechanism is in the third configuration of FIG. 11.

During anytime of transportation of the cassette 110 or when the cassette 110 is coupled to the base 105, the medical professional can actuate the keyed lock 330 to provide another means to securely lock the storage bins 115 to the cassette 110. In particular, the locking mechanism 325 is actuated into the third configuration (FIGS. 11, 12, 21, and 22) such that the rotational movement of the cam member 345 moves the stud 365 into the second portion 360 thereby moving the body 370 upwardly towards the keyed lock 330. In other words, the locking bar foot 390 is positioned away from the bottom surface 180 of the base 105 (if the cassette 110 is coupled to the base 105). Accordingly, the bottom edge 385 aligns with the slidable bar locking protrusions 460 (FIG. 21) and portions of the body 370 engage the slidable bar locking protrusions 460 to securely lock the storage bins 115 within the cassette 110. Stated another way, the locking mechanism 325 positioned in the third, keyed locked configuration (FIGS. 11, 12, 21, and 22) overrides the biasing force of the spring 410 such that the storage bins 115 are secured within the cassette 110 regardless of the location of the cassette 110 (e.g., coupled to the base 110 or located adjacent the centralized medication room). This arrangement might be useful when transporting the cassette 110, or to provide yet another level of locked security when the cassette 110 is positioned in the body 105.

Various features and advantages of the disclosure are set forth in the following claims.

The invention claimed is:

1. A storage cabinet mountable to a wall, the storage cabinet comprising:

a base configured to be fixedly attached to the wall;

a frame coupled to the base, the frame including a first side, a second side, a first cavity defined between the first and second sides, and a second cavity defined between the first and second sides;

first and second storage bins each including a first side and a second side, each storage bin removably positionable within one of the first and second cavities such that the first side of each storage bin is retained within the respective cavity by a flange of the frame extending from the first side of the frame toward the second side of the frame, and the second side of each storage bin is adjacent the second side of the frame; and first and second locks each coupled to the base adjacent the second side of the frame, the first lock configured to selectively engage the second side of the first storage bin to secure the first storage bin in the first cavity, the second lock configured to selectively engage the second side of the second storage bin to secure the second storage bin in the second cavity;

wherein the first lock is operable to be actuated independently relative to the second lock.

2. The storage cabinet of claim 1, wherein engagement between the flange and a portion of the first storage bin adjacent the first side of the first storage bin requires a pivoting motion of the first storage bin about the flange to permit removal of the first storage bin from the first cavity, and wherein engagement between the flange and a portion of the second storage bin adjacent the first side of the second storage bin requires a pivoting motion of the second storage bin about the flange to permit removal of the second storage bin from the second cavity.

3. The storage cabinet of claim 2, wherein the first and second storage bins include a handle extending from the second side, and wherein each handle includes a gripping portion having an opening, and wherein each gripping portion is configured to be gripped by either a right hand or a left hand of an operator to pivot one of the first and second storage bins relative to the frame.

4. The storage cabinet of claim 1, wherein the frame is a cassette that is removably coupled to the base.

5. The storage cabinet of claim 4, further comprising a locking mechanism coupled to the cassette, wherein the locking mechanism secures the first and second storage bins within the respective cavity when the cassette is removed from the base, and wherein the locking mechanism includes a foot extendable through an aperture formed in a bottom side of the cassette, and wherein the locking mechanism allows the first and second storage bins to be removed from the respective cavity in response to the foot engaging a portion of the base when the cassette is coupled to the base or in response to the foot engaging a support surface when the cassette is removed from the base and supported on the support surface.

6. The storage cabinet of claim 5, wherein the base includes a cassette lock that is configured to engage the cassette to secure the cassette to the base.

7. The storage cabinet of claim 5, wherein the locking mechanism includes a keyed lock configured to provide an override configuration of the locking mechanism to secure the first and second storage bins within the respective cavity.

8. The storage cabinet of claim 5, wherein the locking mechanism is a slidable locking bar, and wherein the locking bar is selectively moveable between a unlocked position and a locked position in which the locking bar engages a protrusion on the second side of the first and second storage bins to selectively lock the first and second storage bins within the respective cavity when the cassette is removed from the base.

9. The storage cabinet of claim 8, wherein the locking bar is coupled to a biasing member configured to bias the locking bar to the locked position so that the first and second storage bins are secured within the respective cavity when the cassette is removed from the base, and wherein the bias of the biasing member is automatically overcome to move the locking bar to the unlocked position upon installation of the cassette into the base.

10. The storage cabinet of claim 1, wherein the first side of the first and second storage bins includes a notch configured to receive at least a portion of the flange when the first and second storage bins are positioned within the respective cavity.

11. The storage cabinet of claim 1, wherein the second side of the first storage bin includes a first protrusion configured to engage the first lock and secure the first storage bin within the first cavity, and wherein the second side of the second storage bin includes a second protrusion configured to engage the second lock and secure the second storage bin within the second cavity.

12. The storage cabinet of claim 1, further comprising a first biasing arrangement between the first storage bin and the frame to bias the first storage bin into the first cavity, and wherein the storage cabinet further comprises a second biasing arrangement between the second storage bin and the frame to bias the second storage bin into the second cavity.

13. The storage cabinet of claim 12, wherein the first and second biasing arrangements include a magnet.

14. The storage cabinet of claim 1, wherein a maximum dimension of the storage cabinet is configured to extend about 4 inches away from the wall.

15. The storage cabinet of claim 1, wherein the first and second storage bins define a first dimension extending from the first side to the second side of the respective storage bin, and wherein the frame defines a second dimension extending from a distal end of the flange to the second side of the frame, and wherein the first dimension is greater than the second dimension inhibiting movement of the first and second storage bins relative to the frame in a direction normal to the second dimension when each storage bin is positioned within or removed from the respective cavity.

16. The storage cabinet of claim 1, wherein the base includes a user interface display, and wherein the first and second locks are actuated via the user interface display.

17. The storage cabinet of claim 1, further comprising a storage compartment in the base, and a door pivotably coupled to the storage compartment between a closed position and an open position, and wherein the door is sized and configured such that when in the open position at least one of the first and second storage bins, when removed from the respective cavity, can rest thereon.

18. A storage cabinet mountable to a wall, the storage cabinet comprising:

a base configured to be fixedly attached to the wall;

a cassette removably supported by the base, the cassette including a first side, a second side, a plurality of cavities defined between the first and second sides, and a flange extending from the first side of the cassette toward the second side of the cassette;

a plurality of storage bins each including a first side, a second side, and a notch adjacent the first side, each of the plurality of storage bins is removably positionable within one of the plurality of cavities such that the first side of each of the plurality of storage bins is retained within one of the plurality of cavities by the flange engaging the notch of each of the plurality of storage bins, and the second side of each of the plurality of storage bins is adjacent the second side of the cassette; and a plurality of locks coupled to the base adjacent the second side of the cassette, each of the plurality of locks configured to selectively engage the second side of one of the storage bins to secure the respective storage bin in a respective cavity;

wherein a first lock of the plurality of locks is operable to be actuated independently relative to a second lock of the plurality of locks.

19. The storage cabinet of claim 18, further comprising a locking mechanism coupled to the cassette, the locking mechanism secures the plurality of storage bins within the plurality of cavities when the cassette is removed from the base, and allows the plurality of storage bins to be removed from the plurality of cavities when the cassette is coupled to the base.

20. The storage cabinet of claim 19, wherein the locking mechanism is a slidable locking bar, and wherein the locking bar is selectively moveable between a unlocked position and a locked position in which the locking bar engages a protrusion on the second side of each of the plurality of storage bins to selectively lock the plurality of storage bins within the plurality of cavities when the cassette is removed from the base.

* * * * *